US008381653B2

(12) United States Patent
Zimmermann

(10) Patent No.: US 8,381,653 B2
(45) Date of Patent: Feb. 26, 2013

(54) METHOD AND APPARATUS FOR CHARGING AN UPWARDLY ORIENTED HOLE WITH A PUMPABLE MATERIAL

(75) Inventor: Leon Michael Zimmermann, Johannesburg (ZA)

(73) Assignee: Maxam Dantex South Africa (Propietary) Limited (ZA)

( * ) Notice: Subject to any disclaimer, the term of this patent is extended or adjusted under 35 U.S.C. 154(b) by 0 days.

(21) Appl. No.: 12/961,174

(22) Filed: Dec. 6, 2010

(65) Prior Publication Data

US 2011/0297030 A1 Dec. 8, 2011

Related U.S. Application Data

(63) Continuation of application No. PCT/IB2009/052389, filed on Jun. 5, 2009.

(30) Foreign Application Priority Data

Jun. 5, 2008 (ZA) ..... 2008/04904

(51) Int. Cl.
*F42D 1/10* (2006.01)

(52) U.S. Cl. ..... 102/313

(58) Field of Classification Search ..... 102/312, 102/313, 324, 333, 323, 304; 86/20.15
See application file for complete search history.

(56) References Cited

U.S. PATENT DOCUMENTS 1,298,500 A * 3/1919 Hardel ..... 102/315
2,745,346 A * 5/1956 Kirk et al. ..... 86/20.15
3,170,366 A * 2/1965 Alfredsson ..... 86/20.15
4,036,099 A * 7/1977 French ..... 86/20.15
4,036,100 A 7/1977 Hurley
(Continued)

FOREIGN PATENT DOCUMENTS

DE 20 31 282 A1 1/1971
WO WO 97/17588 A 5/1997
(Continued)

OTHER PUBLICATIONS

International Search Report and Written Opinion of PCT/IB2009/052389 mailed on Nov. 23, 2009, 12 pages.

*Primary Examiner* — Michael Carone
*Assistant Examiner* — Reginald Tillman, Jr.
(74) *Attorney, Agent, or Firm* — Kilpatrick Townsend & Stockton, LLP

(57) ABSTRACT

One aspect of the invention concerns a method of charging an upwardly oriented hole with a pumpable material, typically a pumpable explosive material such as an ANE. In the method of the invention a laterally expandable retainer is provided. This is of smaller length than the hole and has an inlet at a lower end thereof and an outlet at an upper end thereof. In an unexpanded state the retainer has a smaller lateral dimension than the hole. The retainer is inserted upwardly into the hole in an unexpanded state, whereafter material with which the hole is to be charged is pumped upwardly into the retainer through the inlet such that the retainer fills up and expands laterally into engagement with a wall of the hole. Excess pumped material is allowed to upwardly out of the retainer into the hole through the outlet. After the retainer has been filled with material and the hole above the retainer has been at least partially filled with any excess material, the pumping operation is stopped and the inlet is closed. The material is then retained in the hole by engagement of the filled and expanded retainer with the wall of the hole. Another aspect of the invention concerns the apparatus used in the method.

33 Claims, 16 Drawing Sheets

U.S. PATENT DOCUMENTS

| | | | | | |
|---|---|---|---|---|---|
| 4,466,354 | A | * | 8/1984 | Jelberyd et al. | 102/313 |
| 4,522,125 | A | | 6/1985 | Marz | |
| 4,522,129 | A | * | 6/1985 | Jerberyd | 104/138.1 |
| 4,813,358 | A | * | 3/1989 | Roberts | 102/313 |
| 4,829,902 | A | * | 5/1989 | Sharpe et al. | 102/312 |
| 4,966,077 | A | * | 10/1990 | Halliday et al. | 102/313 |
| 5,198,613 | A | * | 3/1993 | Jenkins, Jr. | 102/313 |
| 6,070,511 | A | * | 6/2000 | Palmer et al. | 86/20.15 |
| 6,453,818 | B1 | * | 9/2002 | Brent | 102/313 |

FOREIGN PATENT DOCUMENTS

| | | |
|---|---|---|
| WO | WO 98/41811 A1 | 9/1998 |

* cited by examiner

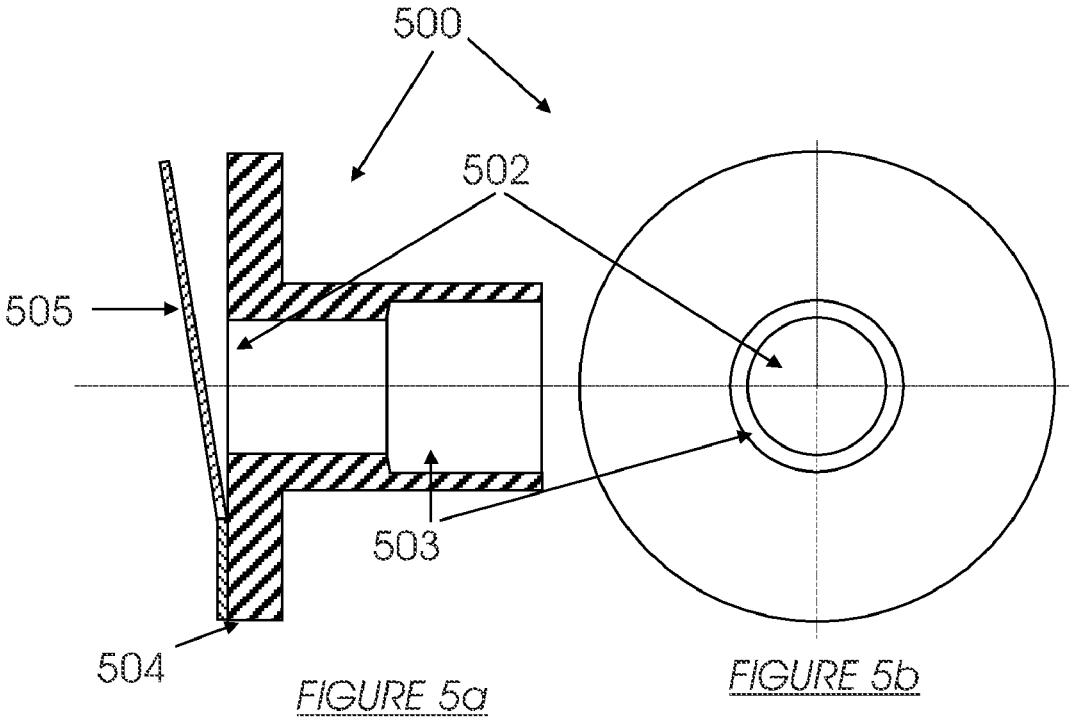
FIGURE 5a
FIGURE 5b
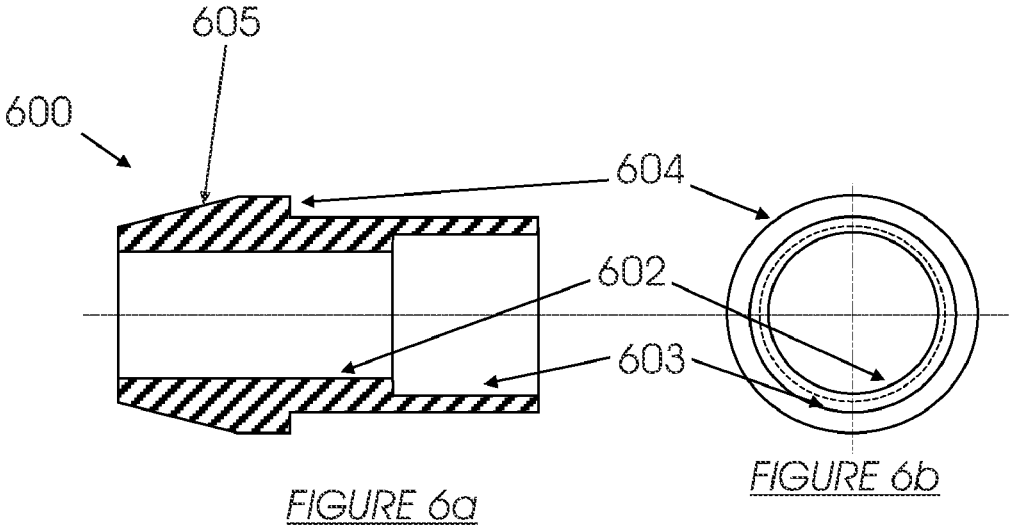
FIGURE 6a
FIGURE 6b

METHOD AND APPARATUS FOR CHARGING AN UPWARDLY ORIENTED HOLE WITH A PUMPABLE MATERIAL

CROSS REFERENCE TO RELATED APPLICATION DATA

The present application is a Continuation of PCT/IB2009/052389 filed Jun. 5, 2009 which application claims priority to ZA 2008/04904 filed Jun. 5, 2008. The full disclosures, all of which are incorporated herein by reference in their entirety, for all purposes.

BACKGROUND TO THE INVENTION

THIS invention relates to a method and apparatus for charging an upwardly oriented hole with a pumpable material. In one application, the invention relates to a method and apparatus for charging an upwardly oriented shot hole, typically in a mine working, with a pumpable explosive.

In many types of underground mining, for example mining using the block caving technique, it is appropriate to drill shot holes upwards into the ore body of the mine from an access tunnel or other working. Depending on the type of mining these holes could be drilled parallel to each other or they could be drilled in a diverging or converging pattern. These holes then need to be charged with explosives in order to break the rock.

If charging is with ANFO it is a relatively easy process as it simply entails blow loading the ANFO into the holes with compressed air. The particles of ANFO are relatively friable which means that when the product is blow loaded the particles break up and the ANFO compacts in the hole. In the case of cartridged explosive the cartridges can be air loaded into the holes where they break and compact on hitting the toe of the hole and thus completely fill the hole and jam in place. If the hole is not excessively long the cartridges can be compacted by hand by using a charging pole to break up the cartridges.

The result is similar to that obtained with air loaded cartridges. In addition when using cartridges it is possible to use any of a variety of proprietary devices for keeping the explosive in place. These are generally made of plastic and are designed to be easy to push into the hole and to lodge therein. Due to their shape such devices are often referred to as 'milking stools' or 'spiders'.

However most modern, major mining operations make use of pumpable explosives delivered from vehicle based devices often referred to as mobile manufacturing units or MMUs. In most cases the product is pumped as a non-explosive which is then mixed with an activator which causes gas bubbles to form in the product, rendering it explosive. These products are classified in the United Nations handbook on dangerous goods as Ammonium Nitrate Emulsions, suspensions or gels and are normally abbreviated ANEs. In some cases the mine will use a highly insensitive explosive with a 1.5 classification. These products are also pumpable and are often sensitized by the inclusion of glass microballoons in the formulation. Irrespective of whether the mine is using an ANE, a 1.5 explosive or any other pumpable material, the problem with an upwardly inclined shot hole is that the material is fluent and therefore has a tendency to flow out of the hole under gravity either during loading or after the hole has been filled.

Various methods are in use to stop the explosive from coming out of the hole but these all have drawbacks of one kind or another. For example, with emulsions some manufacturers incorporate a device in the end of the loading hose that causes the viscosity of the emulsion to increase dramatically as it leaves the end of the hose, with the increased viscosity acting to keep the product in the hole. At least one manufacturer adds a component to the emulsion that causes the product to become sticky such that the stickiness keeps the product in the hole.

With slurries or watergels, which in this group of products are referred to as suspensions or gels, manufacturers add a crosslinking agent to the product as it emerges from the end of the hose. This causes the product to gel or solidify in as little as ten seconds in order to retain the product in the hole.

Even with these measures a problem is that it is possible for air to find its way between the product and the wall of the hole and once this happens it is simply a matter of time before it falls out of the hole. Water running out of the hole and vibrations from the firing of adjacent shots tends to increase the likelihood of the explosive falling out.

In the above systems it is necessary to push the filling hose all the way to the end of the hole before commencing with the charging of the hole and then to withdraw the hose as the hole fills. For short holes this can be done by hand, but for long holes the process normally involves the use of a mechanical hose pusher because a long length of hose full of product can be heavy and difficult to handle. These hose pushers are expensive and if they break down for any reason significant production time could be lost.

It is potentially much simpler to fill the hole from the bottom by pumping the explosive from the collar of the hole to the upper end or toe of the hole. This requires a vent pipe to allow the air to escape as the hole fills with product. For this type of operation there are again a number of methods in use.

One such method involves the use of a solid plug with the vent pipe and filler hose passing through it. The plug may consist of two opposing wedges fitted into the hole in such a way that the pressure of the column of explosive drives the upper wedge into contact with the lower wedge, thereby expanding the wedge combination laterally into locking engagement with the wall of the hole.

However the wedges, which are destroyed in the blast, can be expensive and difficult to install properly. In addition removal of the wedges may be problematical in the event that the explosive needs to be removed from the hole for any reason.

Another known method involves the use of an inflatable ball, with filling and vent lines passing through it, to hold the product in the hole. The ball is equipped with a filling valve to allow it to be inflated with compressed air once it has been placed in the hole. Apart from the expense of the equipment, compressed air is not always available for inflating the ball.

The present invention seeks to provide an alternative method and apparatus for retaining a pumped liquid such as an explosive in an upwardly oriented hole such as a shot hole.

SUMMARY OF THE INVENTION

The invention is defined in the appended claims. In particular, according to one aspect of the present invention there is provided a method of charging an upwardly oriented hole with a pumpable material, the method comprising the steps of:

- providing a laterally expandable retainer which is of smaller length than the hole, which has an inlet at an operatively lower end thereof and an outlet at an operatively upper end thereof and which, in an unexpanded state, has a smaller lateral dimension than the hole;
- inserting the retainer upwardly into the hole in an unexpanded state;

pumping material with which the hole is to be charged upwardly into the retainer through the inlet such that the retainer fills up and expands laterally into engagement with a wall of the hole;

allowing any excess material pumped into the retainer to flow upwardly out of the retainer through the outlet; and after the retainer has been filled with material and the hole above the retainer has been at least partially filled with any excess material, terminating the pumping of the material and closing the inlet such that material is retained in the hole by engagement of the filled and expanded retainer with the wall of the hole.

Typically the pumping of material into the retainer is terminated when the hole, above the retainer, has been filled with excess material to a predetermined level The retainer may be pushed upwardly into the hole by means of a suitably stiff charging conduit which is attached to the inlet of the retainer, and the material may be pumped into the retainer through the charging conduit.

Conveniently the retainer is provided in the form of a length of flexible lay-flat tubing. The method may also comprise providing a non-return valve at the inlet of the retainer, and allowing the non-return valve to close when the pumping of material is terminated. Conveniently the non-return valve is provided in the form of a length of flexible lay-flat tubing which will collapse on itself, and thereby close the inlet, when the pumping of material is terminated. The lay-flat tubing of the non-return valve may have a smaller length and diameter than the lay-flat tubing of the retainer, the method including the step of locating the lay-flat tubing of the non-return valve within the lay-flat-tubing of the retainer.

Still further the method of the invention may comprise the step of inserting a vent pipe into the hole in order to vent air from the hole as it is filled with pumped material. The vent pipe may be inserted into the hole at the same time as the retainer is inserted into the hole.

In the preferred application of the method it is used to charge an upwardly oriented shot hole with a pumpable explosive. In this application the method may also comprise the step of inserting a blast initiator into the hole such that the initiator is located at an upper end of the hole. Typically the blast initiator is inserted into the hole at the same time as the retainer and vent pipe are inserted into the hole.

The blast initiator may be attached to the vent pipe and the vent pipe may be attached to the charging conduit, the method comprising the step of pushing the vent pipe and charging conduit upwardly into the hole at the same time.

In one particular application, in which the shot hole is charged with a decked charge, the method may comprise the steps of providing a plurality of retainers, providing a charging conduit for each retainer, providing a blast initiator for each retainer, and inserting the retainers and blast initiators simultaneously into the hole such that the retainers are situated one above the other and spaced apart from one another with a blast initiator adjacent each retainer. A single vent pipe may be provided, the vent pipe having an inlet therein for each space between two retainers and above the uppermost retainer.

In the preferred embodiment, the charging conduits are provided as separate conduits each of which extends to the mouth of the shot hole for connection to an explosive supply conduit. In this embodiment, the retainers may be filled with explosive material in turn from the lowermost retainer to the uppermost one. The charging conduits may be attached to one another and to the vent pipe, typically by adhesive tape.

According to another aspect of the invention there is provided an apparatus for charging an upwardly oriented hole with a pumpable material, the apparatus including a laterally expandable retainer which is of smaller length than the hole, which has an inlet at an operatively lower end thereof and an outlet at an operatively upper end thereof and which, in an unexpanded state, has a smaller lateral dimension than the hole, the retainer being insertable upwardly into the hole in an unexpanded state and being expandable into engagement with a wall of the hole when material with which the hole is to be charged is pumped into the retainer through the inlet such that the retainer fills up and expands laterally into engagement with a wall of the hole, with excess material being able to flow upwardly out of the retainer through the outlet, and means for closing the inlet after the retainer and at least a portion of the hole above the retainer have been filled with material and pumping of material has been terminated, such that engagement between the filled and expanded retainer and the wall of the hole serves to retain the material in the hole.

Other features of the method and apparatus of the invention are described below and are set forth in the claims.

BRIEF DESCRIPTION OF THE DRAWINGS

The invention will now be described in more detail, by way of example only, with reference to the accompanying drawings in which:

FIGS. 5*a* and 5*b* respectively show cross-sectional side and end views of an alternative type of attachment device forming part of an apparatus according to this invention;

FIGS. 6*a* and 6*b* respectively show cross-sectional side and end views of another alternative type of attachment device forming part of an apparatus according to this invention;

DESCRIPTION OF THE ILLUSTRATED EMBODIMENTS

Figures 1A, 1B:
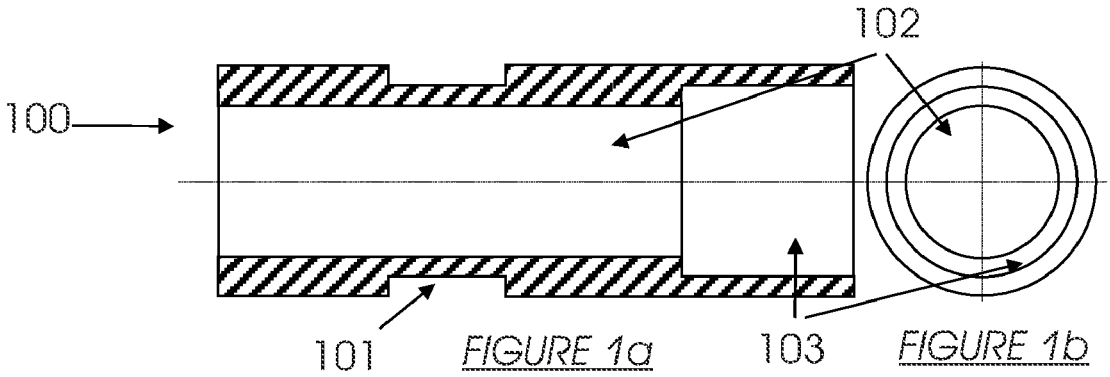
FIGS. 1*a* and 1*b* respectively show cross-sectional side and end views of an attachment device forming part of an apparatus according to this invention.
Figures 2A, 2B:
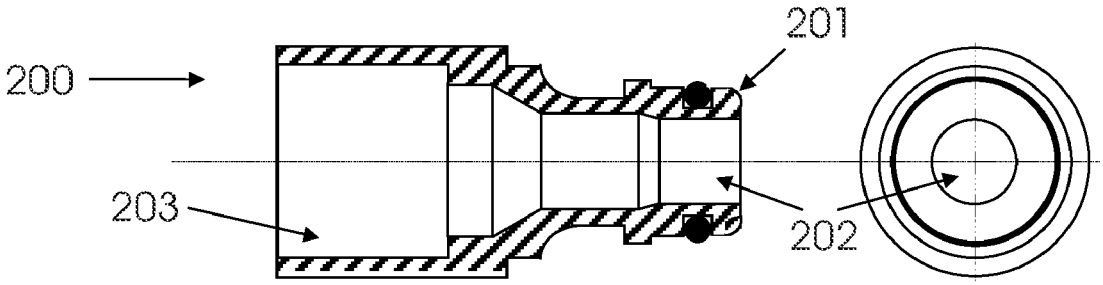
FIGS. 2*a* and 2*b* respectively show cross-sectional side and end views of a quick-connector forming part of the apparatus of the invention.
Figure 3:
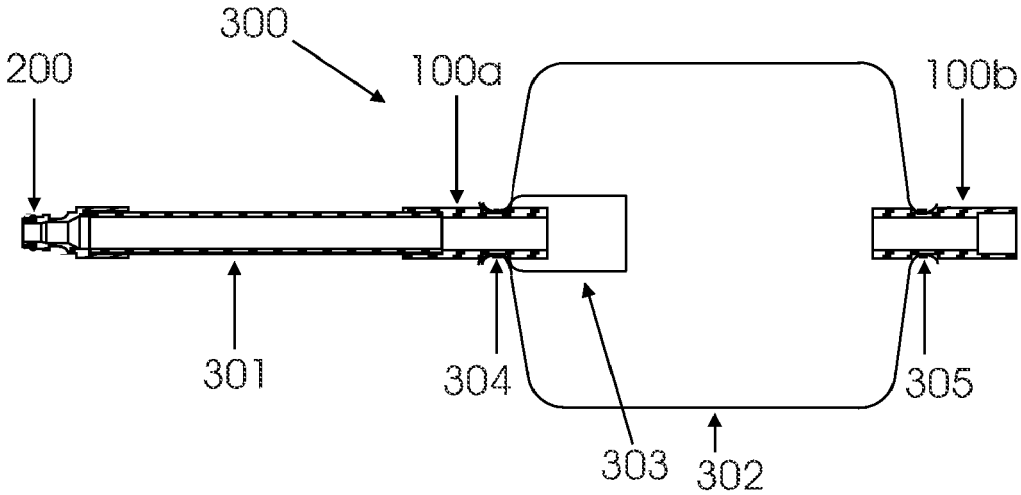
FIG. 3 diagrammatically illustrates a first embodiment of apparatus according to the invention.

Reference is made initially to FIG. 3 which shows a cross sectional view of one embodiment of apparatus 300 according to the invention. In this Figure, the numeral 200 indicates a quick connector for attachment to a charging conduit. The quick connector is seen in more detail in FIGS. 2*a* and 2*b*. The numerals 100*a* and 100*b* in FIG. 3 indicate identical attachment devices one of which, designated 100, is seen in more detail in FIGS. 1*a* and 1*b*. The numeral 301 indicates the charging conduit, in the form of a length of tube of suitable stiffness, diameter and length, through which ANE will be pumped. In one example, the charging conduit may be provided by a length of 20 mm PVC (polyvinyl chloride) or polyethyelene tube.

If the connector 200 and attachment devices are made of a suitable polymer then they can be attached to the conduit 301 by adhesive. For example, if they are made of PVC, the assembly can be made up with standard PVC cement, making the assemblies quick and economical to produce.

In this embodiment the apparatus 300 includes a retainer 302 provided by a length of flexible lay flat tubing of a diameter selected for the shot hole being drilled. The flat width of this tubing is such that when the tubing is filled its expanded diameter is greater than the diameter of the hole. The retainer 302 is attached concentrically to a shorter length of smaller diameter lay flat tubing 303 by the attachment device 100. In practice, one end of the lay flat tubing 303 is secured around a recess 101 in the attachment device 100*a* by a holding means, in this case a standard electrical cable tie or a wire tie 304. The opposite end of the tubing 303 is open.

In this embodiment of the invention the other end of the retainer 302 is secured in similar manner around the corresponding recess 101 of the second attachment device 100*b* by means of a cable tie or wire tie 305.

The length of the retainer 302 will depend on the length of hole that it is desired to charge but in any case would normally be only a small fraction of the total length of the hole. The choice and thickness of material from which the retainer 302 is made could vary according to the application and length of hole. For example the tubing forming the retainer could be of rubber, polyethylene, polypropylene, PVC or of laminated construction. Alternatively it could be made of a knitted or woven material with or without an impervious liner such as polyethylene. It could be a laminate of woven or knitted material with an impervious, flexible lining such as for example PVC, polyethylene or the like.

The length of the tubing 303 is typically at least about 1.5 times the diameter of the attachment device 100.

FIG. 1 a shows a cross sectional view of one embodiment of attachment device 100. The attachment device 100 has the abovementioned recess 101 around which the lay flat tubing of the retainer, and the lay flat tubing 303, are secured. The numeral 102 indicates a central flow passage 102 for pumped material and the numeral 103 a recessed end into which the end of the conduit 301 is connected.

The quick connector 200 seen in FIG. 2*a* is designed to cooperate with the standard female component of a conventional "push-pull"-type garden hose connector, for example one of the type sold under the trade mark Gardena. In FIG. 2*a*, the numeral 202 indicates the central passage for the ANE and the numeral 203 a recessed end into which the opposite end of the conduit 301 is connected.

In FIG. 3, the attachment device 100*a* serves as an inlet to the retainer 302, the attachment 100*b* as an outlet from the retainer and the lay flat tubing 303 as a non-return valve.

FIGS. 4*a* to 4*e* show sequential stages in the operation of the apparatus 300 in a shot hole 400 drilled vertically upwardly into a rock mass 401.

Figure 4A:
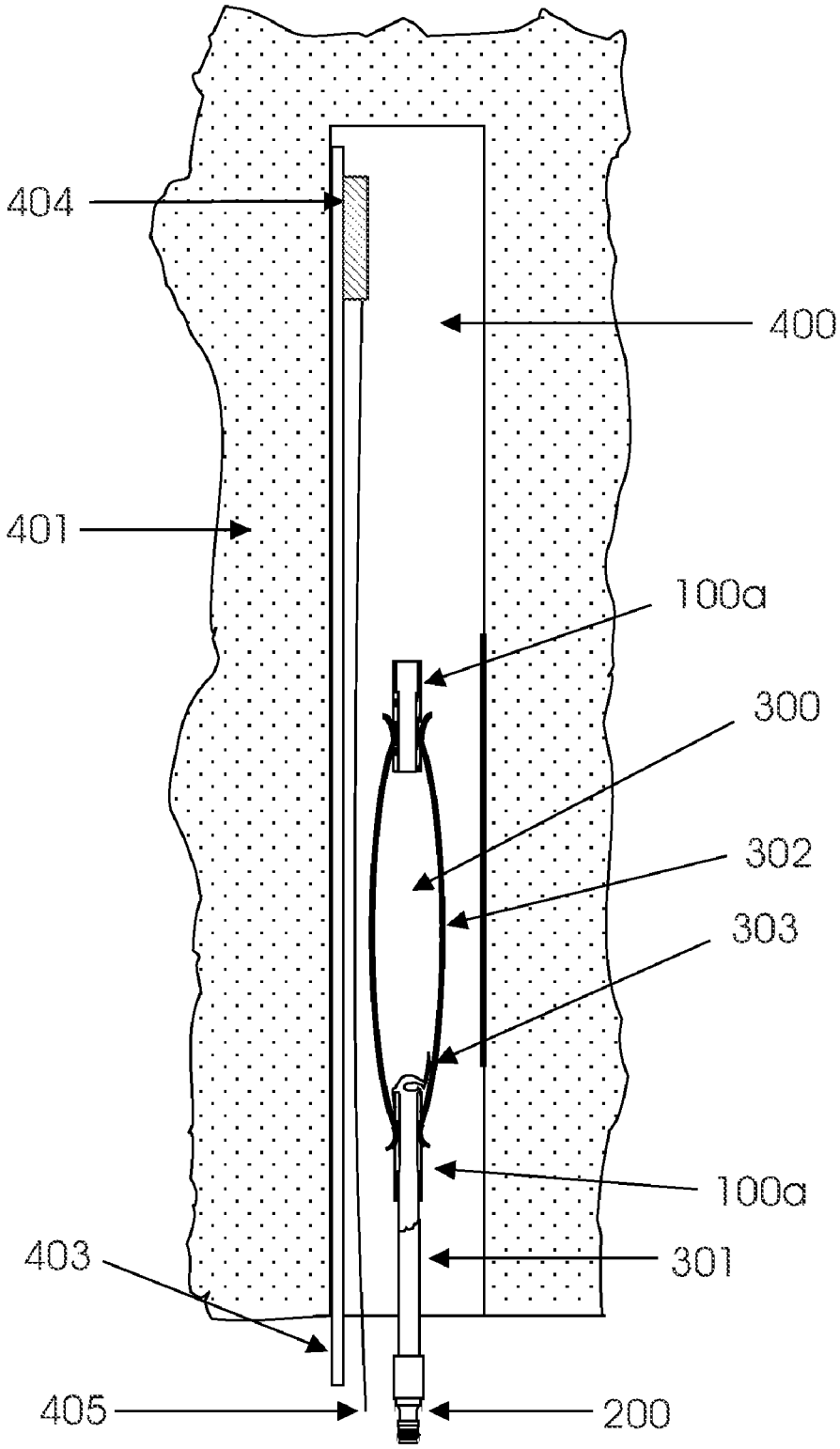
FIGS. 4*a* to 4*e* diagrammatically illustrate sequential stages in the use of the apparatus seen in FIG. 3 in a method according to the invention.

FIG. 4*a* illustrates the apparatus before commencement of the charging operation. The lay flat tubing of the retainer 302 is initially completely collapsed, i.e. flattened, to facilitate insertion into the hole as shown in FIG. 4*a*.

It will also be understood that the apparatus 300 seen in FIG. 3 is light, compact and easy to handle. A large number of such apparatuses can be transported underground easily and conveniently.

The numeral 403 in FIG. 4*a* indicates a vent pipe which is installed in the hole 400 either before, during or after installation of the apparatus 300 to allow to air to vent from the hole during subsequent charging of the hole with pumped explosive, as described below. It is also necessary to install a blast initiator 404. This may be either a detonator on its own or a detonator and booster depending on the sensitivity of the explosive material charged into the hole. In general it is most convenient to attach the initiator 404 to the vent pipe 403 in order to place the initiator at or near the toe or upper end of the hole where it will generally produce the best blast results. The initiating line 405 attached to the initiator 404 may be a shock tube, electrical wiring or a safety fuse, depending on the type of detonator, and protrudes out of the lower end of the hole after installation. The line 405 is connected to the rest of the firing circuit once all the holes required for the blast have been loaded or charged.

It will be understood that the relatively stiff charging conduit 301 can be used to push the retainer 302, in a collapsed or flattened state, up the hole 400. The depth of insertion of the retainer and the length of the charging conduit 301 are such that the quick coupler 200 protrudes from the collar of the hole for subsequent quick coupling of a filling hose (not shown).

Depending on the material used to make the retainer 302 and also depending on its length, it may be convenient to attach the connector 100*b* loosely to the vent pipe 403 so that these two components can be installed simultaneously into the hole without the lay flat tubing of the retainer doubling over, kinking or otherwise deforming during such installation.

Figure 4B:
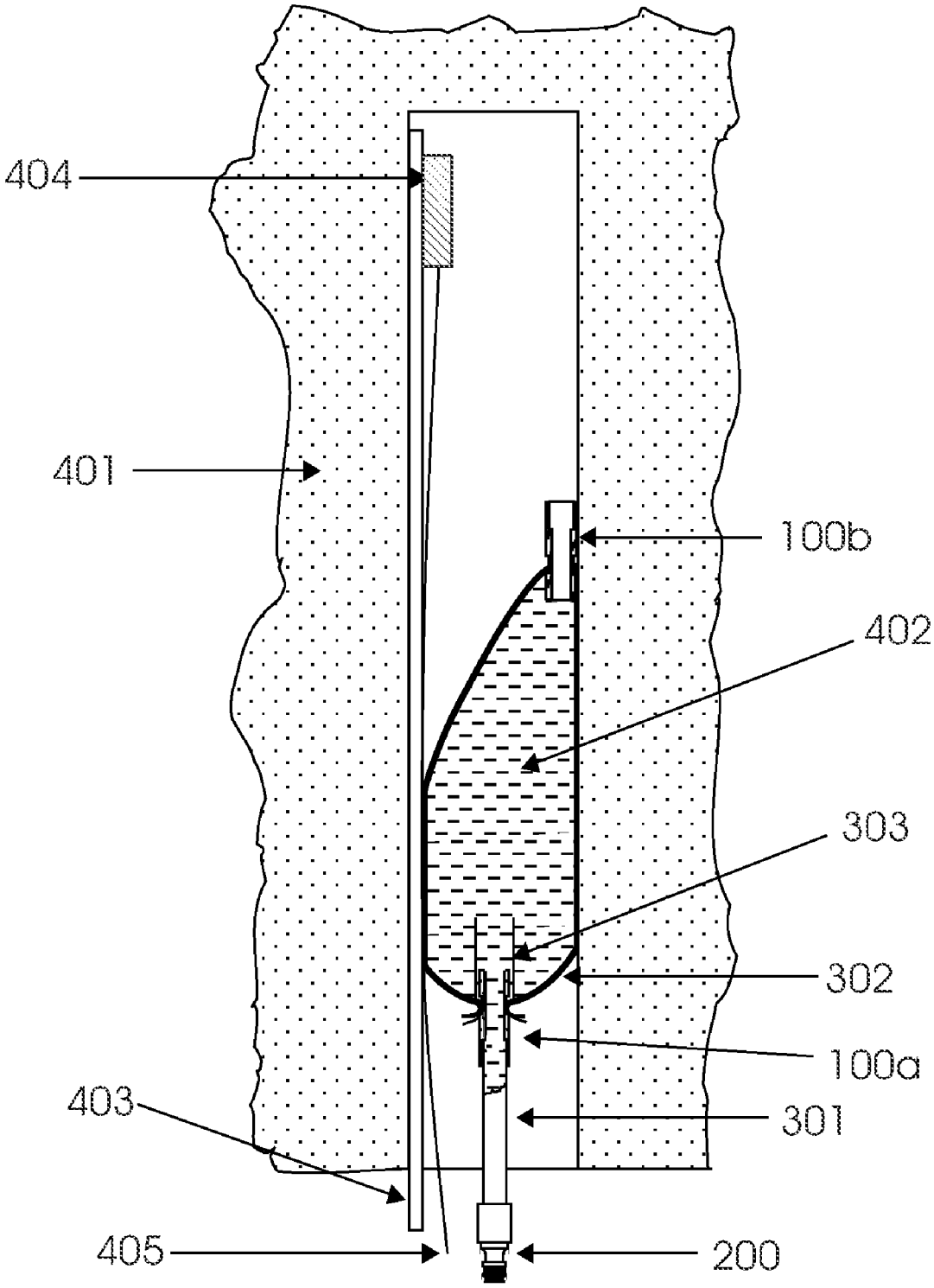
Figure 4C:
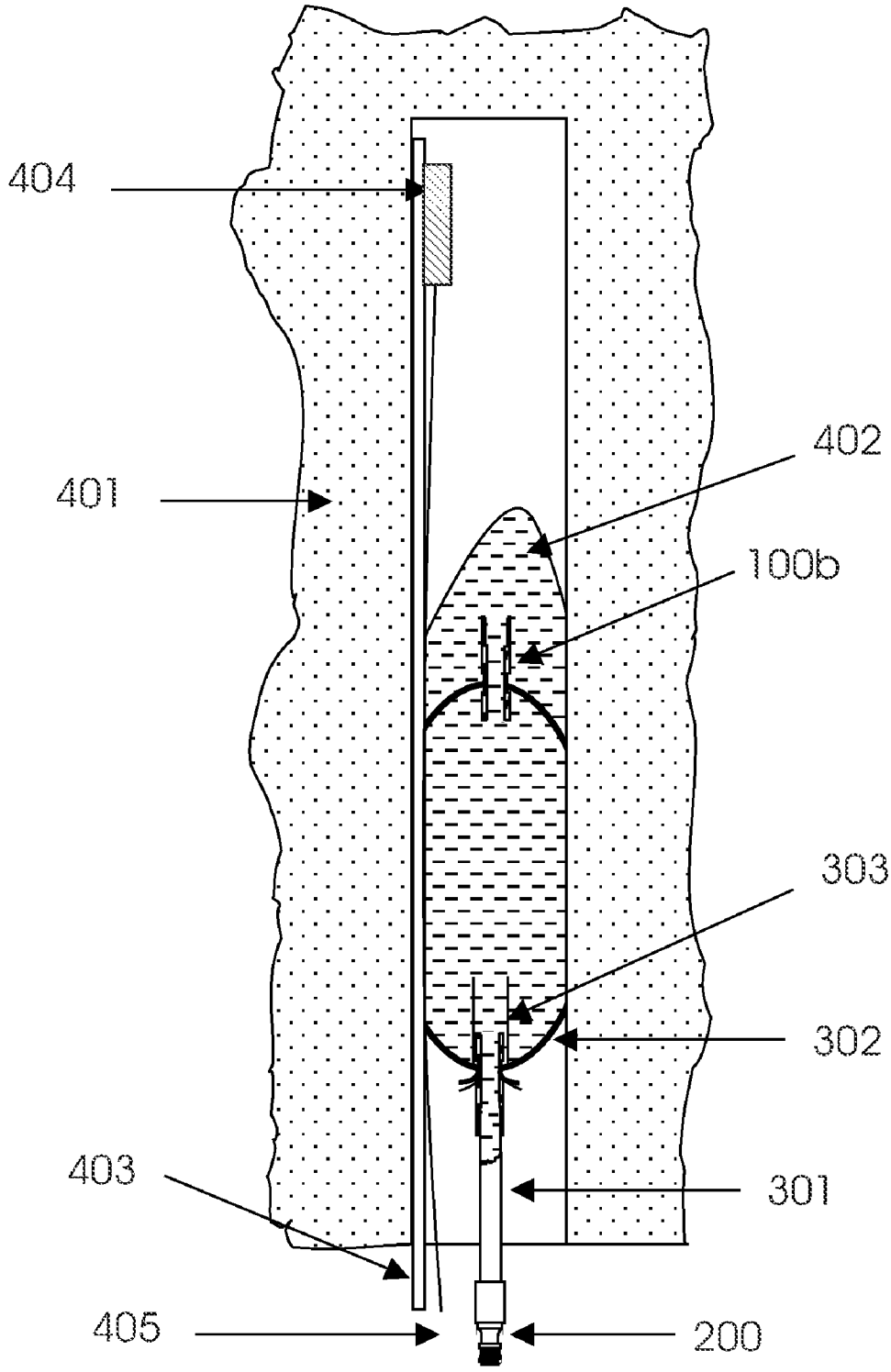

FIG. 4*b* shows the apparatus shortly after commencement of a pumping operation in which explosive material, i.e. the ANE, is pumped through the filler hose, charging conduit 301, attachment device 100*a* and lay flat tubing 303 into the retainer 302. The ANE 402 enters the retainer 302 and inflates it, causing it to expand laterally into engagement with the wall of the hole 400. As pumping continues the retainer 302 is pumped full of the ANE as shown in FIG. 4*b*. Thereafter ANE emerges from the attachment device 100*b* into the hole above the retainer, and continues to fill the hole as shown in FIG. 4*c*.

As indicated above the short length of lay flat tubing 303 acts as a non-return valve. As long as pumping continues this tubing remains open and allows passage of the ANE.

As the hole is filled with pumped material the static pressure inside the retainer is greater than that at higher elevations, and this maintains the retainer in an expanded condition and in firm engagement with the wall of the hole and prevents the retainer from slipping out of the hole under gravity.

If the lay flat tubing of the retainer 302 is made of an elastomeric or stretchable material such as rubber, latex or neoprene the retainer could initially be of smaller diameter than the hole 400. In this case, the pumping pressure would serve to expand the retainer radially into engagement with the wall of the hole.

Figure 4D:
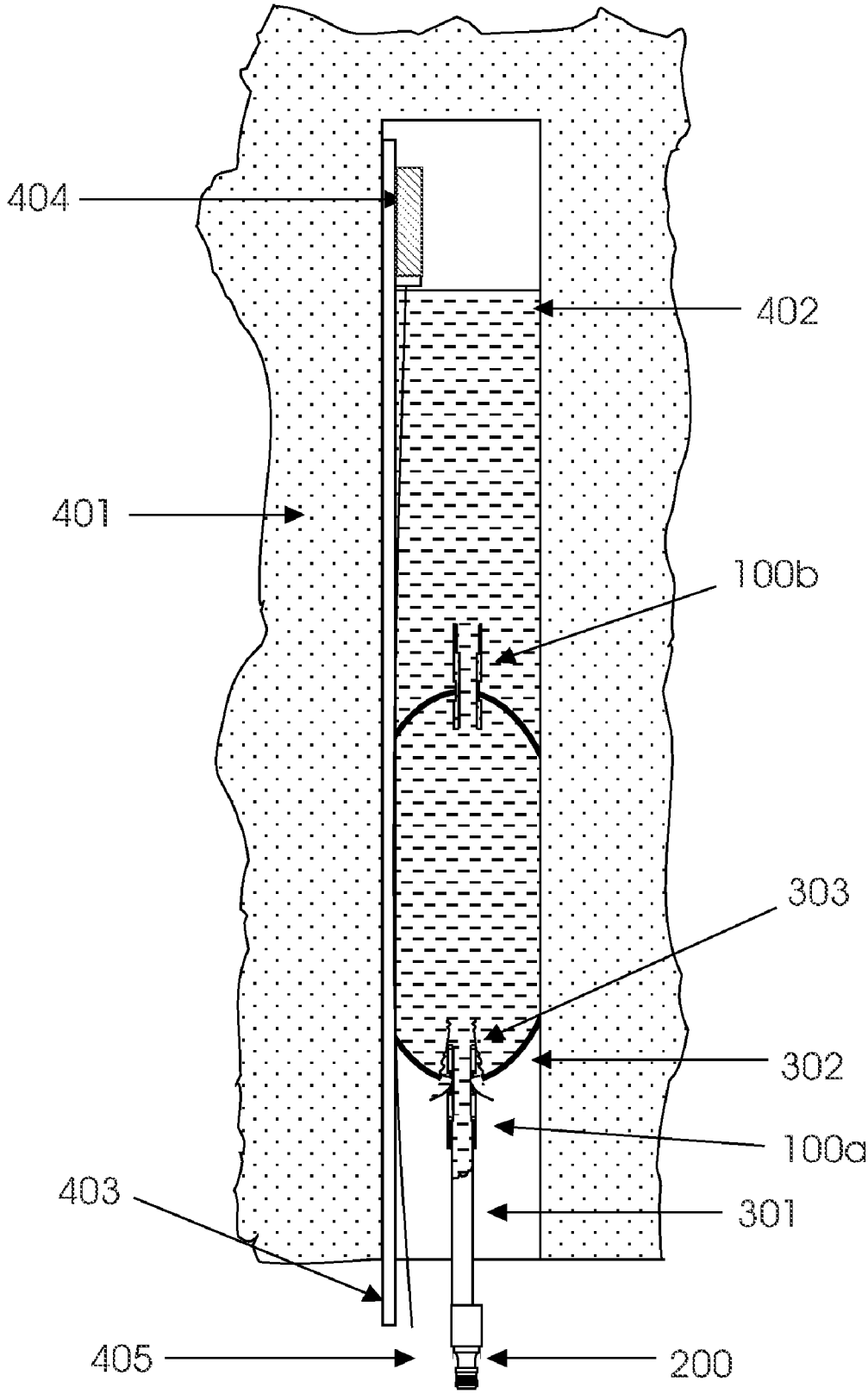

When the situation depicted in FIG. 4*d* is reached, pumping is terminated. In a case where a chemically gassed ANE is used pumping would normally be terminated some time before the hole is completely full. As the material then gasses its volume would expand to fill the hole completely as shown in FIG. 4*e*.

After termination of pumping, the filler hose is uncoupled from the charging conduit 301. As the internal pressure in the hole is then greater than the external pressure the material inside the hole 400 tries to push back out of the charging conduit. When this happens, the lay flat tubing 303 is collapsed and closes, for example by doubling back on itself as shown in FIG. 4*e*, thereby preventing escape of the ANE. Once the product has completely gassed all air previously in the hole will have been displaced through the vent pipe 403.

Figure 4E:
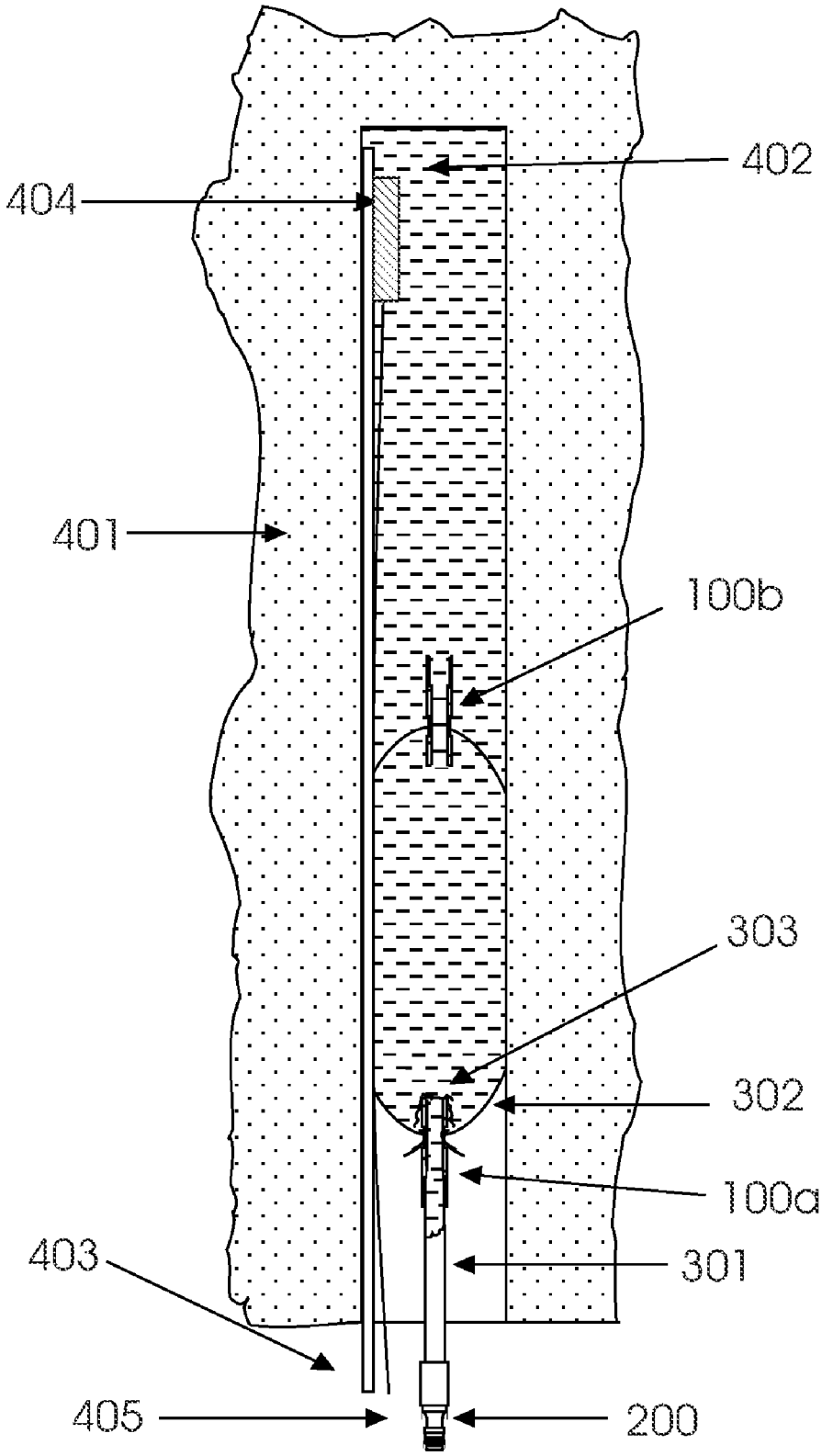

In a situation where the hole is charged with material that has been sensitised with glass micro-spheres, for example, pumping would normally only be terminated once the hole is completely full as shown in FIG. 4*e*. In this situation as well, the internal pressure would collapse the tubing 303 to prevent the material product from escaping through the charging conduit.

After the charging operation described above has been completed, the charge in the hole may be detonated in the conventional manner. If it is for any reason necessary to remove the charge from the hole before blasting takes place, this can be achieved simply and safely by pulling on the lower, protruding end of the charging conduit in order to extract the retainer 302 and allow the material which was previously trapped in the hole to flow out under gravity. If required the hole can then be washed out with water.

Figure 8:
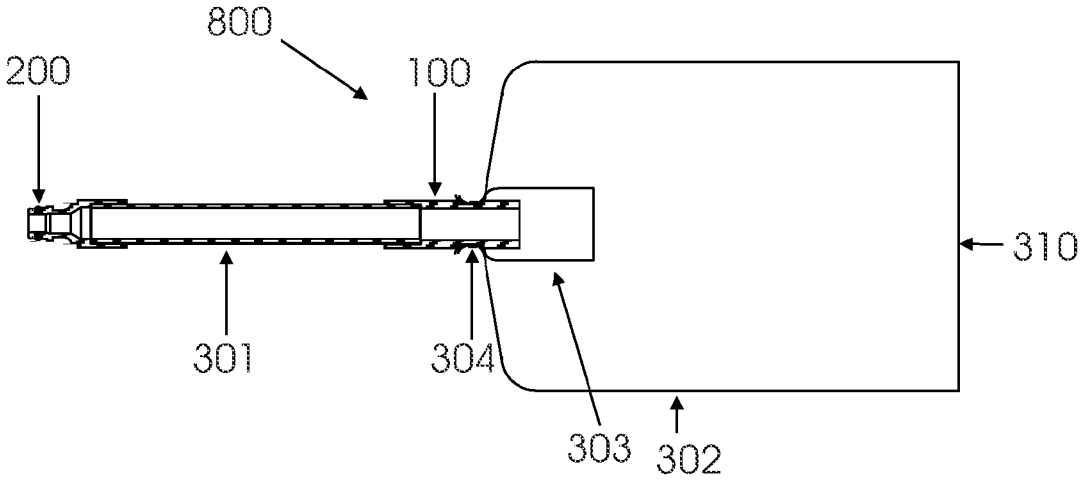
FIG. 8 diagrammatically illustrates a second embodiment of apparatus according to the invention.

FIG. 8 shows a second embodiment of apparatus 800 of the invention. Components corresponding to those of the first embodiment are designated by the same reference numerals.

In this embodiment there is no attachment device corresponding to the device 101*b*. Instead, the end 310 of the retainer 302 is left open. The open end accordingly serves as an outlet from the retainer.

FIGS. 9*a* to 9*d* show sequential stages in the operation of the apparatus 800 in a shot hole 900 drilled vertically upwardly into a rock mass 901. The numeral 903 indicates a vent pipe, the numeral 904 the blast initiator and the numeral 905 the initiating line. As in the first embodiment it is most convenient to attach the initiator 904 and the upper end of the retainer 800 to the vent pipe 903 during installation.

Figure 9A:
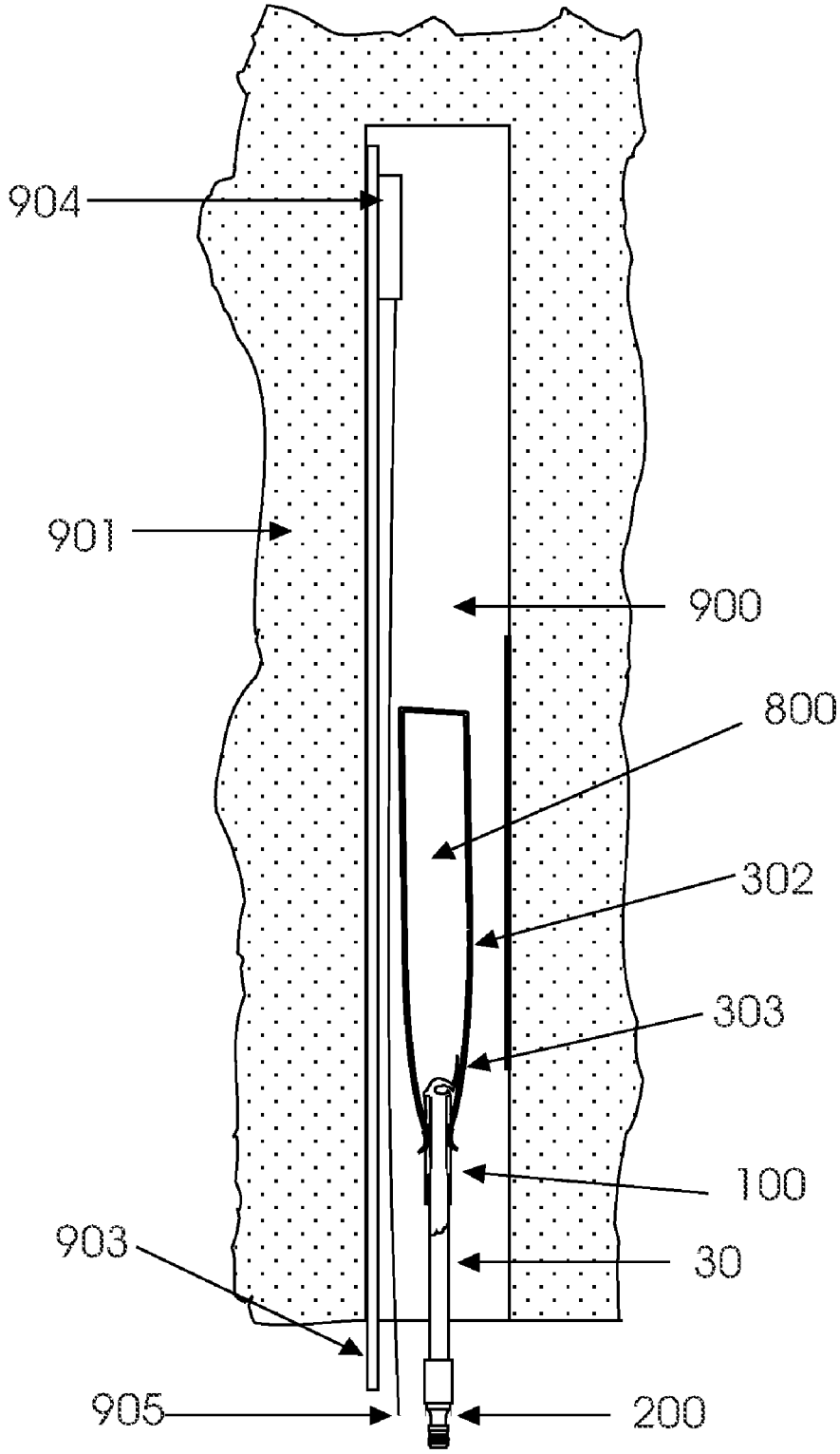
FIGS. 9*a* to 9*d* diagrammatically illustrate sequential stages in the use of the apparatus seen in FIG. 8 in a method according to the invention.
Figure 9B:
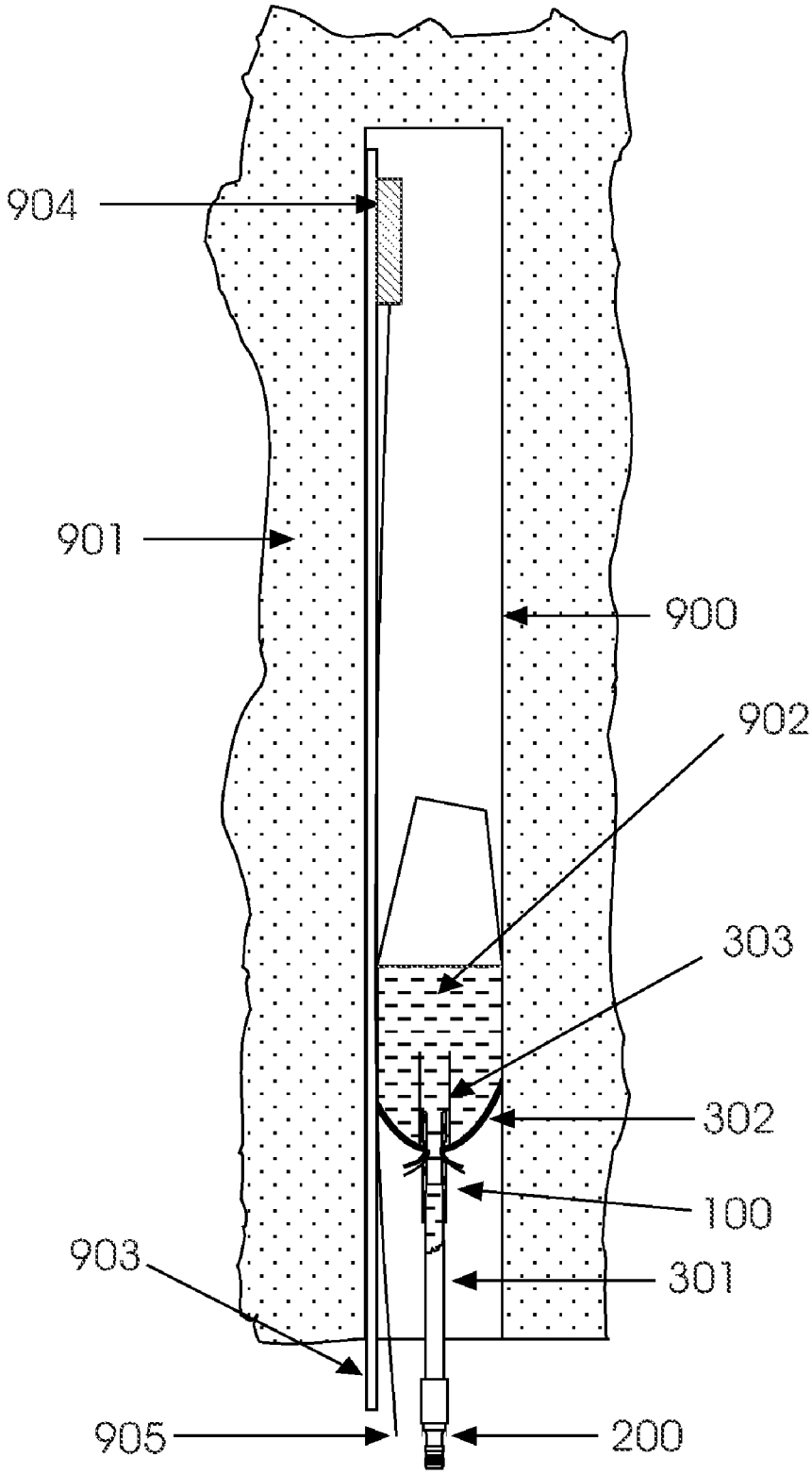
Figure 9C:
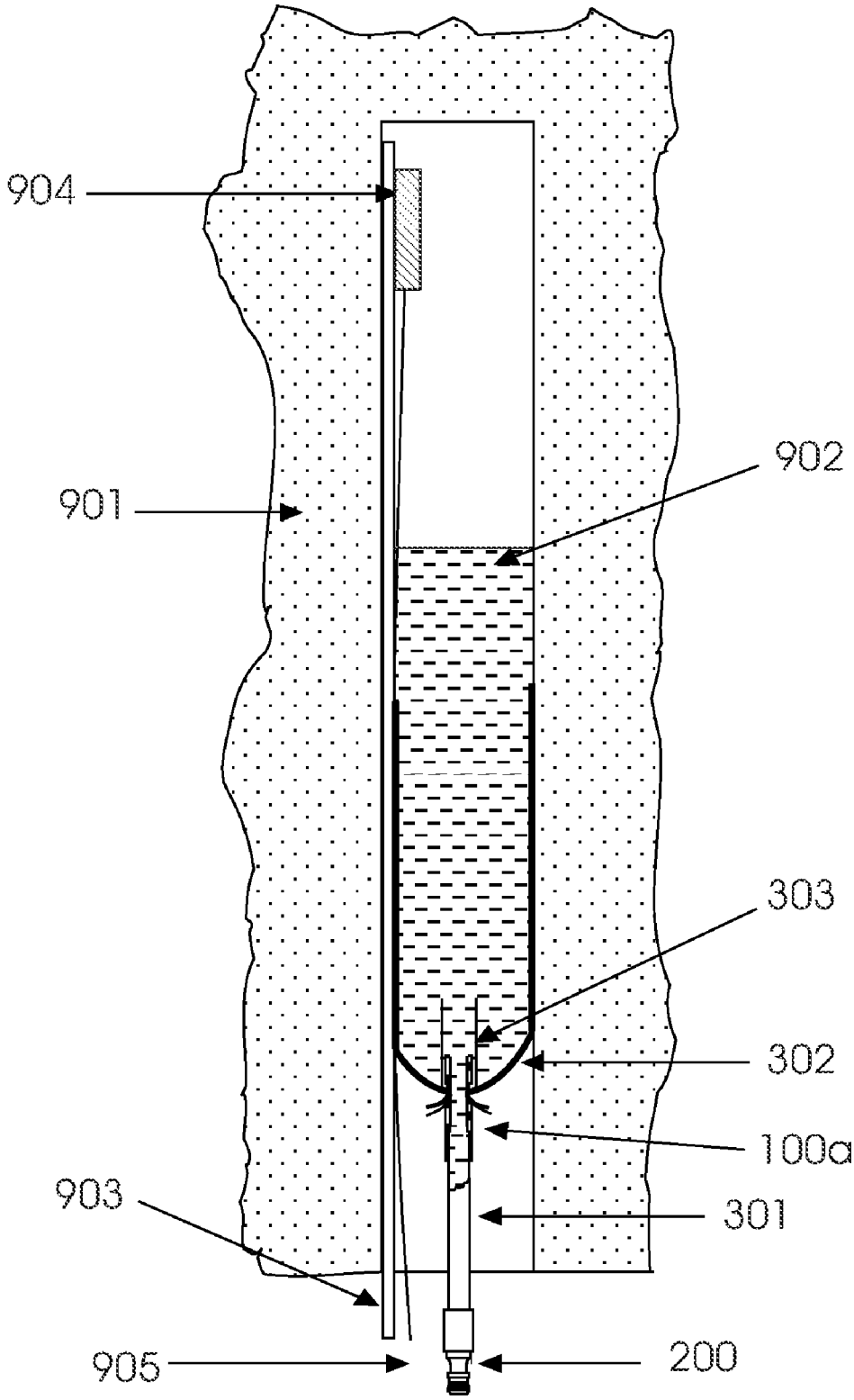
Figure 9D:
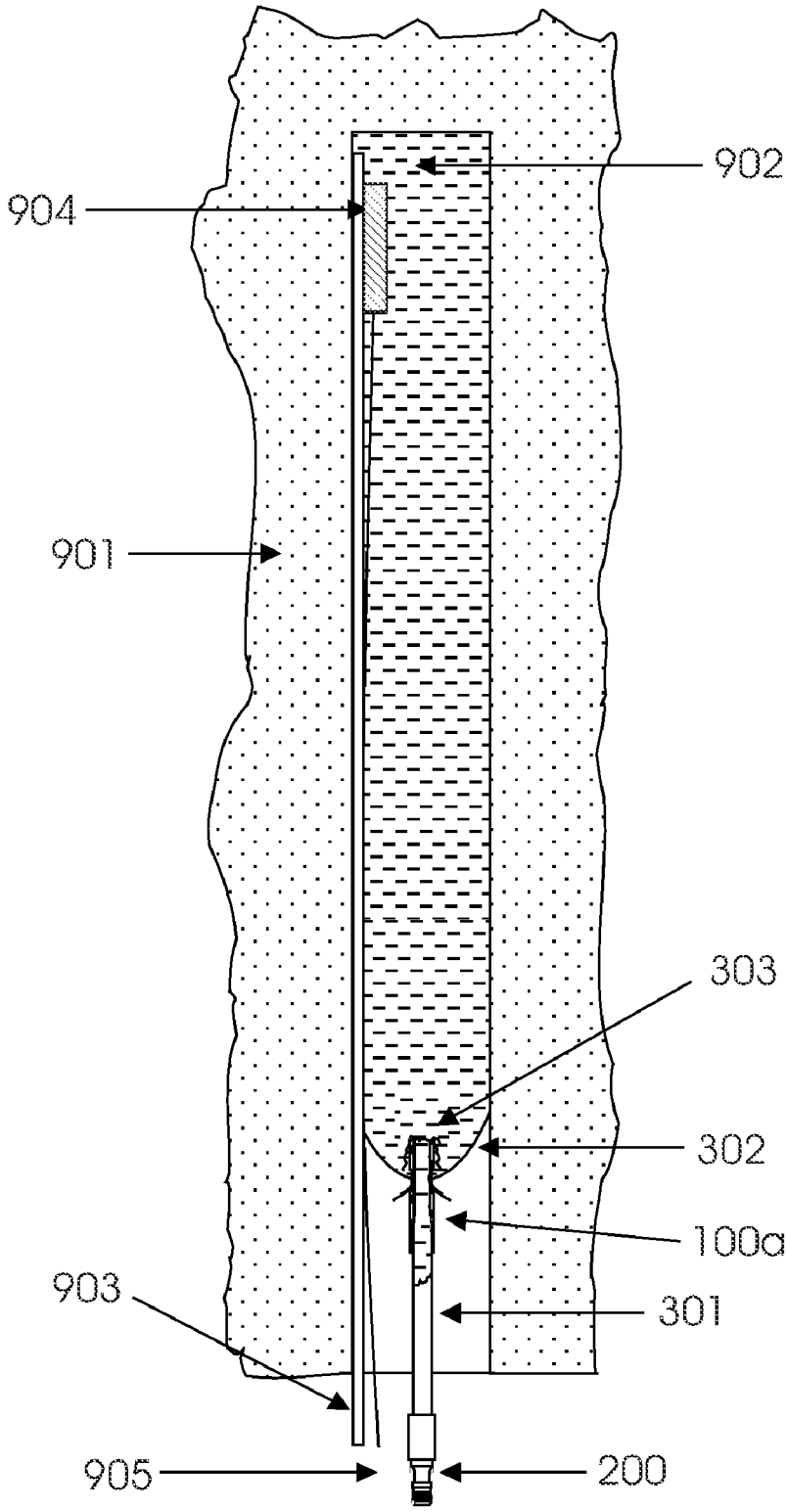
Figures 10A, 10B, 10C, 10D:
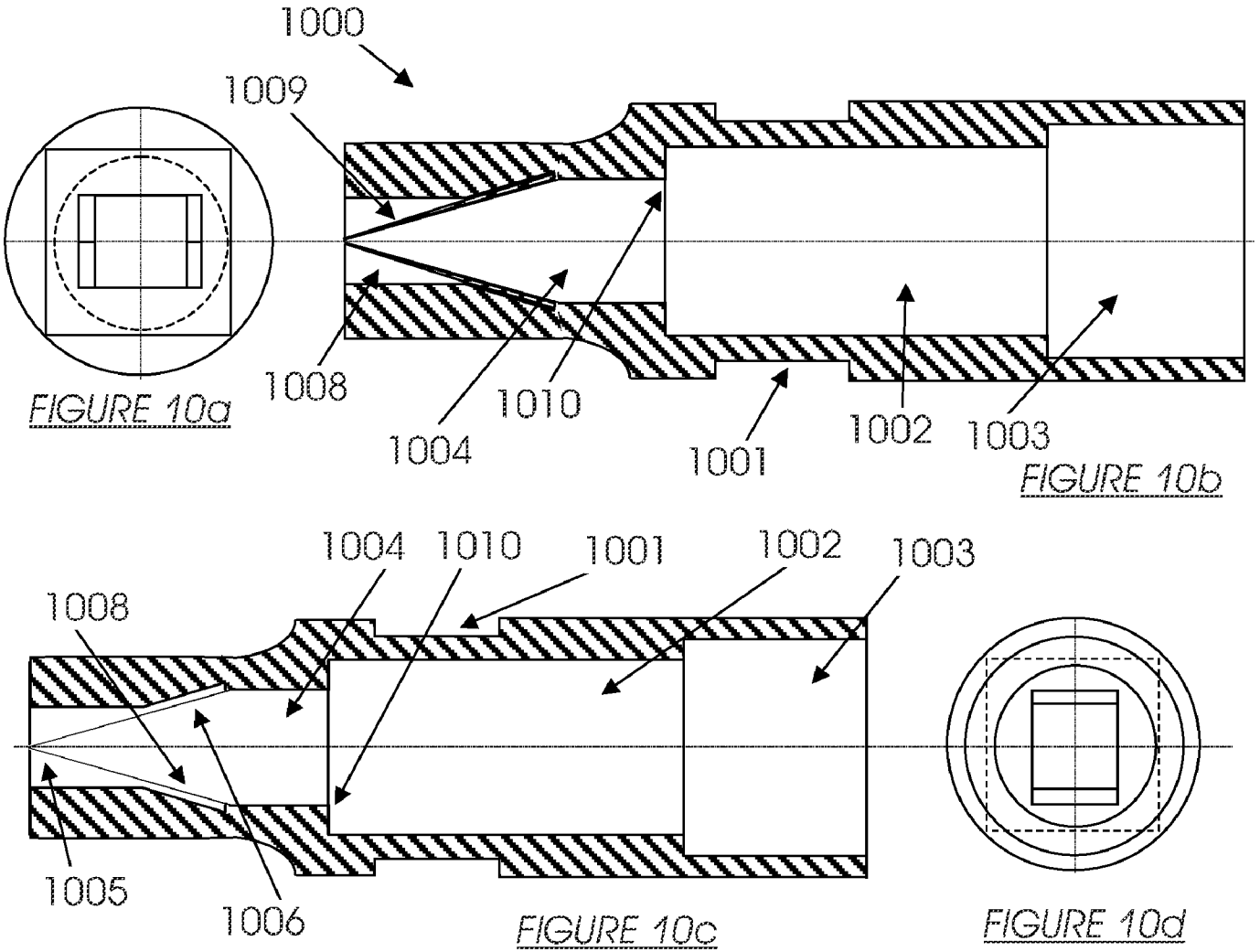
FIGS. 10*a* to 10*d* show cross-sectional side and end views of yet another type of attachment device forming part of an apparatus according to this invention.

As shown in FIG. 9*b* the retainer 800 is initially expanded by the pumped material into engagement with the wall of the hole 900. After the retainer has been filled, further pumped material flows upwardly into the hole above the retainer through its open upper end as shown in FIG. 9*c*. After charging and gassing, as shown in FIG. 9*d*, the hole is completely charged. As in the first embodiment the lay flat tubing 303 acts as a one-way valve and is collapsed upon itself to prevent loss of material from the hole after pumping has been terminated.

FIGS. 5*a* and 5*b* show an alternative attachment device 500 which can replace the device 100*a*. The device 500 also incorporates a non-return valve to replace the lay flat tubing 303. The non-return valve in this case is provided as a simple flap valve 505. A flange 504 provides an attachment point for the lower end of the retainer 300, 800, and there is a recessed end 503 to which the upper end of the charging conduit 301 can be connected.

In practice, the flap 505 may be designed to offer significant resistance to the passage of the pumped material. Where the pumped material is an emulsion, the shear forces applied to the material by the flap could be used to increase the viscosity of the material and thereby improve the retention of the emulsion in the hole.

FIGS. 6*a* and 6*b* illustrate another form of attachment device 600 which has a retaining shoulder 604 at the end of a tapered head 605 in which facilitates fitment of a non-return valve in the form of a small diameter length of lay flat tubing, such as the tubing 303 in FIG. 3. The numeral 602 indicates the central flow passage and the numeral 603 the recessed end to which the charging conduit 301 is connected.

Figure 7:
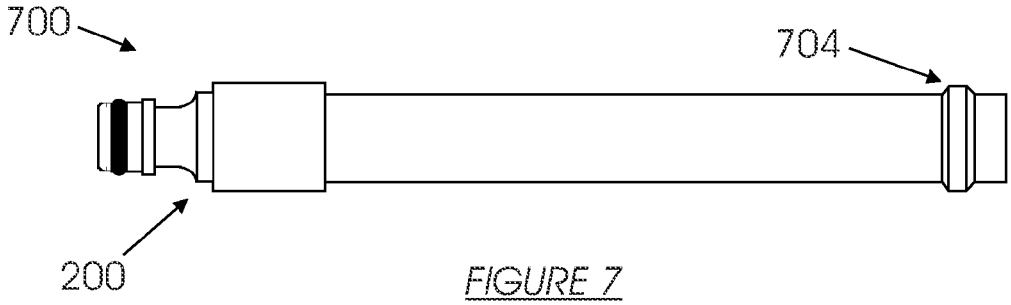
FIG. 7 shows a side view of a charging conduit forming part of an apparatus according to the invention.

FIG. 7 illustrates a charging conduit 700 in which the quick connector 200 is mounted on the operatively lower end and a collar 704 is provided towards the other, operatively upper end. In this case the small diameter lay flat tubing 303 and the lower end of the retainer 300, 800 could be fastened to the upper end of the charging conduit by, for example, circumscribing cable ties located on either side of the collar 704.

FIGS. 10*a* to 10*d* illustrate another version of the attachment device for the lower end of the retainer. The device includes a non-return valve provided by opposing flaps 1008 and 1009 (shown only in FIG. 10*b*) which are fitted into slots 1006 and 1007 on opposite sides of a rectangular passage section 1004. There is a recess 1001 for attachment of the lower end of the retainer and a recessed end 1003 for connection of the upper end of the charging conduit. The flow passage through the device consists of the passage section 1004 and coaxially aligned sections 1002 and 1005 to convey the pumped material. If the pumped material is an emulsion, the flaps 1008 and 1009 could be of relatively stiff material to apply shear forces to the emulsion in order to increase its viscosity.

Figure 13:
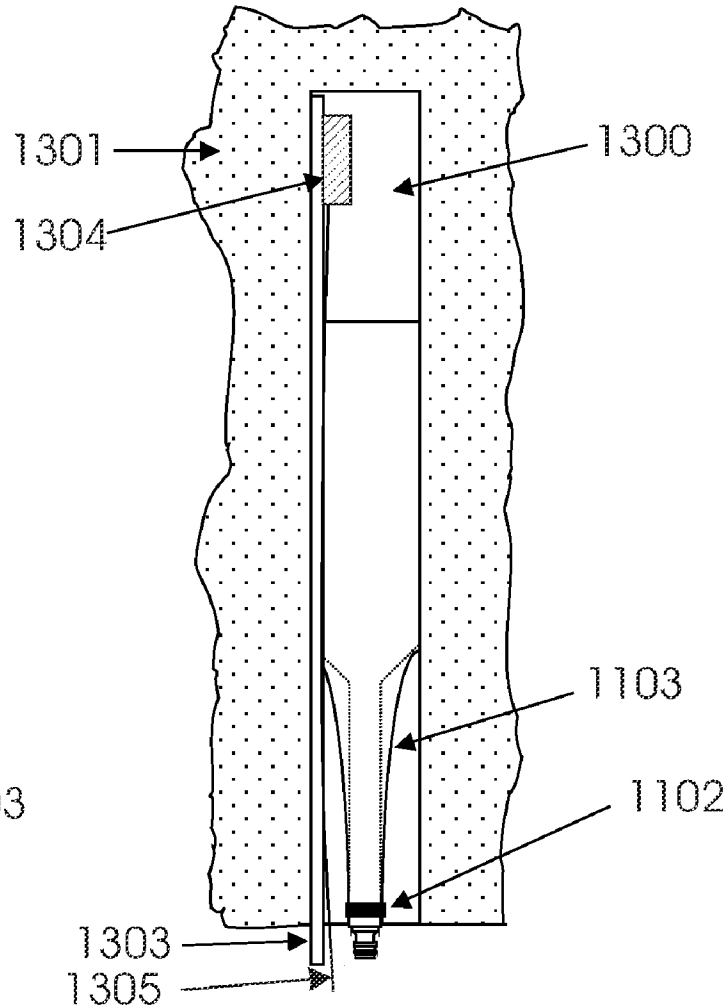
FIGS. 11 to 13 diagrammatically illustrate a third embodiment of apparatus according to the invention.
Figure 11:
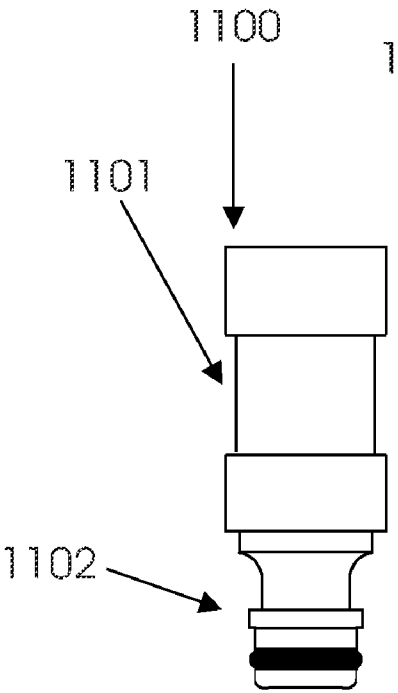

FIG. 13 illustrates an apparatus according to a third embodiment of the invention. In this embodiment a quick coupler 1102 forms part of an attachment device 1100 (FIG. 11). The device 1100 includes an annular recess 1101 for attachment of the lower end of the retainer.

Figure 12:
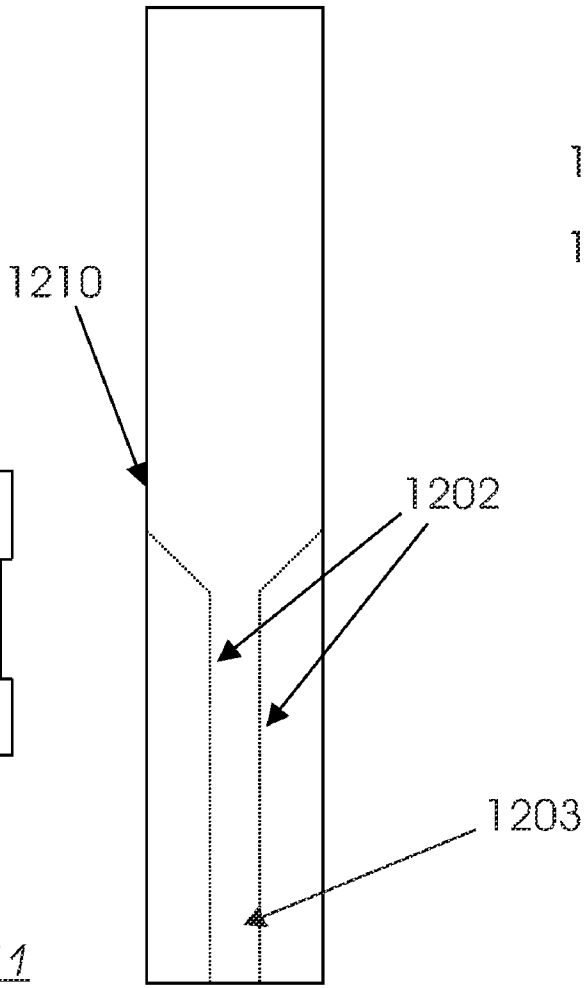

In the embodiment of FIG. 13 there is no separate charging conduit corresponding to the conduits 301 seen in earlier Figures. In this case the retainer 1201 and charging conduit are combined in a single unit by partitioning off part of the lay flat tubing at one end to form a charging conduit, as indicated in FIG. 12 by broken lines 1202. Partitioning can be achieved by various means depending on the type of lay flat tubing used. If, for instance, the lay flat tubing is a material such as polyethylene partitioning can be achieved by heat sealing. Alternatively if it is a material such as polypropylene or polyester it can be achieved by ultrasonic welding. As yet another alternative, if the tubing material is a woven or knitted material such as woven polypropylene partitioning can be achieved by means of stitching.

In each case the partitioning results in the formation of a charging conduit in the form of a narrow passage 1203 the lower end of which can be fitted over the attachment device 1100 and tied in position at the recess 1101. After charging of the hole, this passage establishes an uncharged region 1103 in the hole 1300 in the illustrated rock mass 1301.

In this embodiment, the passage 1203, serving both as the charging conduit and as the inlet to the retainer, can be closed by tying it off or rolling it up after charging so there is no requirement for a separate non-return valve. A non-return valve, for example a short length of lay flat tubing similar to that designated 303 in FIG. 3, could nevertheless be included in the passage if automatic closure of the passage is preferred.

An advantage of the embodiment of FIG. 13 is that if it is desired to insert stemming at the mouth or collar of the hole, it is possible to fold or roll up the lower, uncharged end of the unit into the hole along with the stemming. For additional security in very long holes where the retainer is subjected to substantial static pressure forces tending to eject it from the hole, this embodiment also has the advantage that it provides the facility for installation of further anchorage devices at the mouth of the hole to hold the retainer in place.

In certain cases it is necessary to distribute explosive charges throughout the shot hole. In a normal quarry situation this is achieved by sequentially loading explosive together with an initiator, inert material, further explosive with an initiator, further inert material and so on until the hole is full. This is referred to as "deck charging". This type of blasting is often carried out when ground vibration is a problem as it ensures that only a limited quantity of explosive is detonated at one time, thereby limiting the instantaneous energy delilvered to the ground and hence limiting such vibration.

Deck charging of upwardly oriented shot holes has hitherto been extremely difficult or impossible. However the various embodiments described above allow for deck charging to be carried out in such holes.

Figure 14:
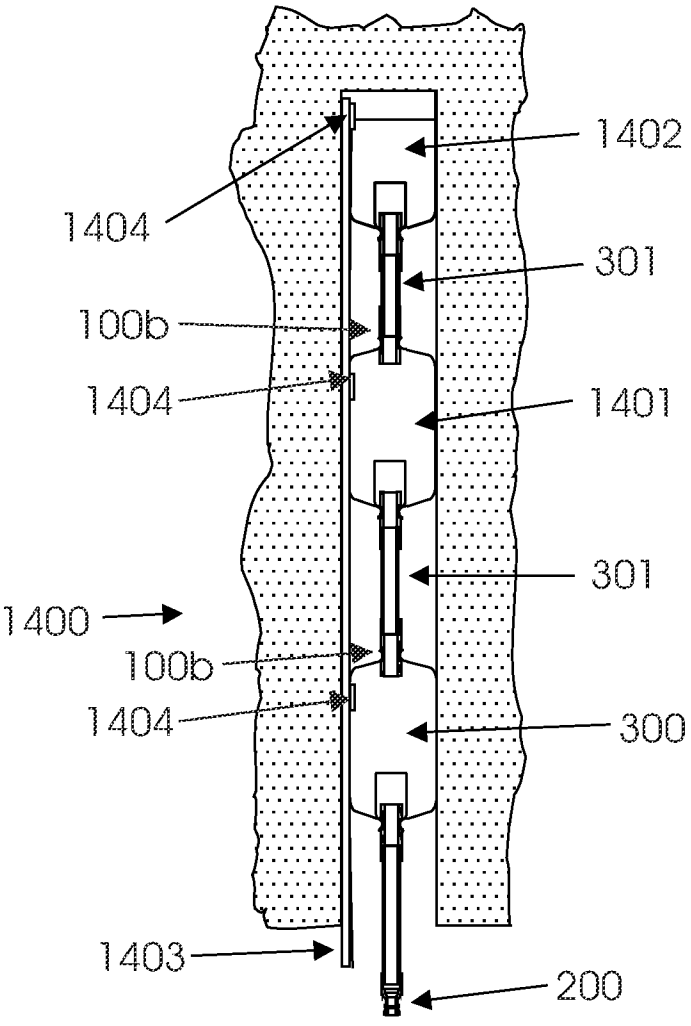
FIG. 14 illustrates apparatus according to the invention which can be used to carry out a decked blast in a shot hole.

FIG. 14 illustrates one embodiment of a deck charging system. The deck charging apparatus seen here includes an apparatus 300 of the type illustrated in FIG. 3. In this case, the retainer 302 is of sufficient volume when expanded to accommodate the entire charge needed for the lowest deck. An intermediate charging conduit 301 is connected between the outlet at the top of the retainer of the apparatus 300 and the retainer of a similar apparatus 1401 located above the apparatus 300. The connection between the conduit 301 and the retainer of the apparatus 1401 could be by way of a quick coupling arrangement similar to those described above. Depending on the length of the hole and the number of decks that are required, one or more further apparatuses could be installed as well, as exemplified by the apparatus 1402 above the apparatus 1401. The uppermost retainer, in FIG. 14 that of the apparatus 1402, has an open top.

A multi-deck assembly 1400 such as that seen in FIG. 14 can most conveniently be installed in a shot hole by firstly attaching the assembly to the vent pipe 1403, together with the initiators 1404, so that when the assembly is pumped full of product the components are correctly positioned with an initiator alongside the retainer of each deck, as illustrated. The initial attachment could for instance be made using adhesive tape. After attachment to the vent pipe and initiators for each deck the assembly is inserted into the hole until the upper end of the vent pipe contacts the upper end of the hole. The filler hose (not shown) is connected to the quick coupler 200 and pumping is commenced. Material firstly enters the retainer 302 of the apparatus 300. Once that retainer has been filled, material flows through the next section of charging conduit into the retainer of the next apparatus 1401, and so on until all the of the retainers have been filled.

As described above, the expansion which takes place when each retainer is filled brings it into engagement with the wall of the hole. In the result, the entire assembly is retained in the hole, after charging of the retainers, by engagement of the retainers with the wall of the hole. With correct initial layout of the components relative to one another, the individual blast initiators are located adjacent the respective, charged retainers allowing, if required, for delayed firing of the charges. In this case, the lengths of charging conduit between the various decks would have a diameter less than the critical diameter of the explosive being used in order to ensure that when the first deck detonates it does not simply propagate the detonation to the other decks simultaneously.

Figure 15:
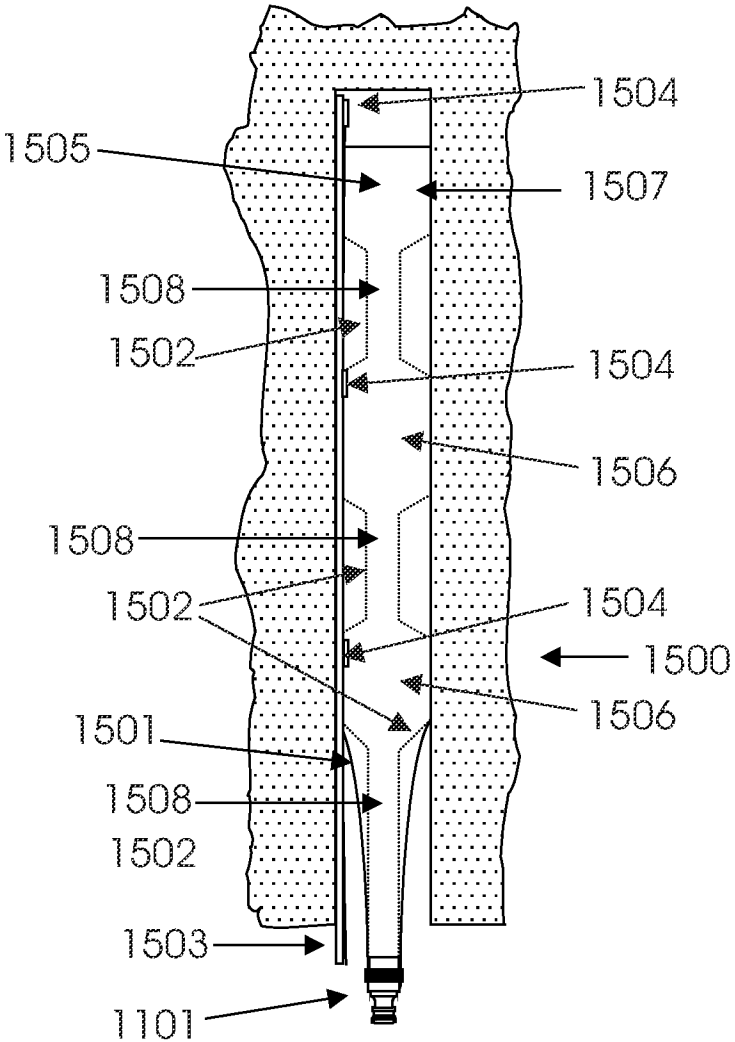
FIG. 15 illustrates another apparatus according to the invention which can be used to carry out a decked blast in a shot hole.

FIG. 15 illustrates an embodiment of a decked apparatus which includes a multi-deck arrangement formed by a single length of lay flat tubing 1505 partitioned off into full diameter retainers 1506 at the various decks and small diameter passages 1508 serving as intermediate charging conduits. As in FIG. 12, partitioning is indicated by broken lines 1502. As with the embodiment of FIG. 12, the required partitioning can be achieved by lines of stitching, heat sealing or ultrasonic sealing, depending on the material chosen. The uppermost full diameter retainer 1507 is open as in FIG. 12. The initiators 1504 and the lay flat tubing 1505 are attached to the vent pipe 1503, by means of adhesive tape for example, to facilitate insertion of the entire assembly, as a unit, into the hole. Pumping of explosive material takes place as described previously. Blast propagation between decks is prevented by the fact that the small diameter passages 1508 are below the critical diameter for the explosive being used.

With the embodiments of FIGS. 14 and 15, if it is desired to remove the decked charges from the hole for any reason it is simply a matter of pulling on the lowermost charging conduit or on the device 1101 in order to extract the entire assembly in a safe manner. If it is required the hole can then be washed out with water.

Figure 16:
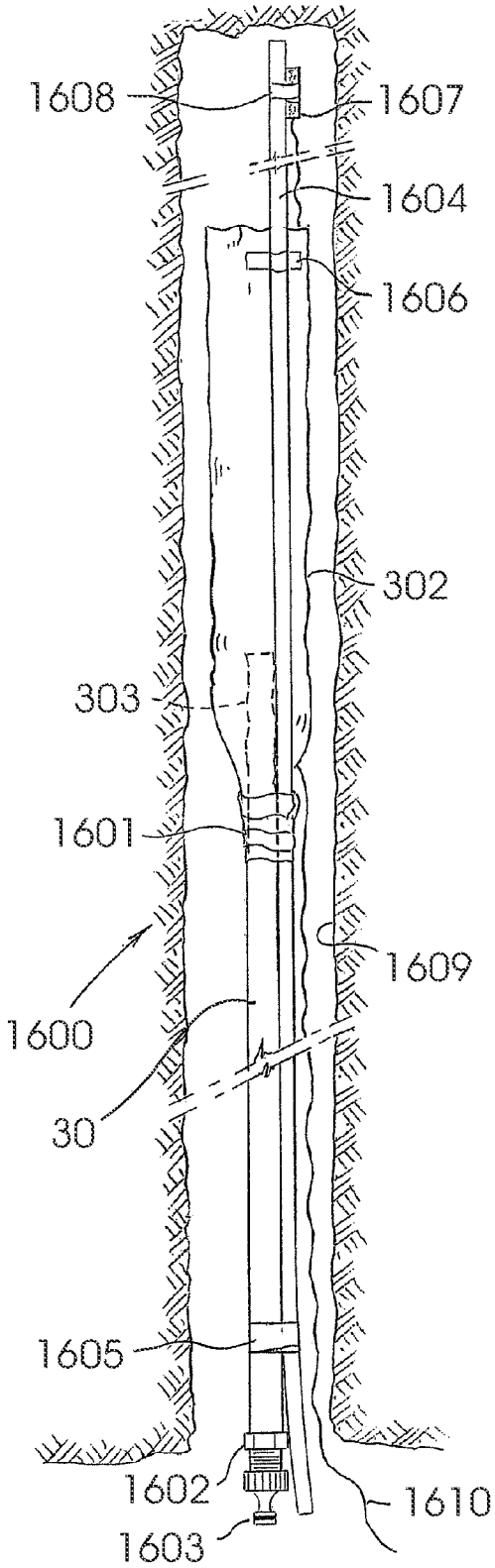
FIG. 16 illustrates another embodiment of apparatus according to the invention installed in a drilled shot hole.

FIG. 16 illustrates an embodiment of the invention which is similar in principle to the embodiment seen in FIG. 8, but which is somewhat simpler and more economical to manufacture than the earlier embodiment. Components corresponding to components of the FIG. 8 apparatus are designated by the same reference numerals.

The apparatus 1600 seen in FIG. 16 includes a retainer 302 provided by an open-ended sleeve of lay flat tubing and a non-return valve provided by a shorter, open-ended sleeve of smaller diameter lay flat tubing 303. During assembly a lower, open end of the valve sleeve 303 and a lower, open end of the retainer sleeve 302 are positioned and wrapped or otherwise constricted around an operatively upper end of the charging conduit 301, and are fastened to the conduit by means of adhesive duct tape 1601, either separately or together.

In this example the charging conduit 301 is provided by a length of 20 mm polyethylene irrigation pipe. The spigot of a standard 20 mm threaded coupler 1602 is inserted into the lower end of the conduit, whereafter a standard male Camlock-type quick-coupler 1603 is threaded onto the coupler 1602.

As in the earlier embodiments, the length of the charging conduit is selected according to the length of the drilled hole 1609 which is to be left uncharged. The length of the retainer sleeve 302 is only a fraction of the length of the hole that is to be filled with explosive. For example a retainer sleeve length less than 2 m in length can easily retain an explosive column of 10 m or more.

The numeral 1604 indicates a vent pipe provided by a length of 12 mm polyethylene irrigation pipe. The length of the vent pipe 1604 is selected to be at least equal to or slightly greater than the length of the drilled hole. Towards its lower end, the vent pipe is fastened to a lower end of the charging conduit 301 by adhesive duct tape 1605. The open upper end of the retainer sleeve 302 is fastened to the vent pipe by adhesive duct tape 1606 at a position selected such that when the vent pipe is extended, as shown in FIG. 16, the retainer sleeve is maintained in a straight, extended condition and will not double over when the assembly is pushed into the drilled hole 1609. A blast initiator 1607 is fastened to an operatively upper end of the vent pipe by means of adhesive duct tape 1608. The numeral 1610 indicates the initiator leads or shock tubes extending to the blast initiator.

In use the assembly described above is pushed up the drilled hole 1609 to the position illustrated in FIG. 16. The charging conduit 301 and vent pipe 1604 are sufficiently stiff to enable this to take place.

In order to charge the drilled hole with explosive material, an explosive supply hose is connected to the quick-coupler 1603 via a corresponding female coupler, and material is pumped through the supply hose. The explosive material passes through the conduit 301, through the valve sleeve 303, fills the retainer sleeve 302 and overflows from that sleeve into the hole through the open upper end of the sleeve. Air displaced by the explosive material can escape from the hole 1609 through the vent pipe 1604.

As before, the retainer 302 expands and jams in the hole 1609 during charging. Before pumping of the explosive material takes place it is also possible to lodge a stemming or other mechanical restraining device in the mouth of the hole to provide greater security against the material and assembly falling out of the hole under gravity.

Sufficient explosive is pumped into the hole, in the manner described with reference to FIG. 8, such that after gassing of the explosive material, the hole is completely filled with the material. Alternatively, as also described previously, the hole may be fully charged with pumped material in situations where the explosive material has been pre-sensitised either with glass microspheres or mechanical gassing.

It will be understood that, as in the embodiments described above, the valve sleeve 303 collapses under the pressure applied from above and acts as a one-way valve to prevent reverse flow of the explosive material through the charging conduit 301. Accordingly, once charging of the hole has taken place, the female coupler can be detached from the quick-coupler 1603. Thereafter the quick-coupler can be unscrewed from the coupler 1602 for re-use in the charging of another blast hole. It is also is also feasible for the coupler 1602 itself to be recovered for re-use.

After the steps described above, the initiator leads or shock tubes are connected up and the shot can be fired.

It will be appreciated that the single-deck embodiment of FIG. 16 is particularly simple and economical, particularly as a result of the use of relatively inexpensive duct tape to make the various connections and the possible re-use of the couplers 1602 and 1603. Other components such as the charging conduit, vent pipe and lay-flat sleeves 302 and 303, which may in practice be provided by tubular lengths of polythene or the like, are also relatively inexpensive.

Figure 17:
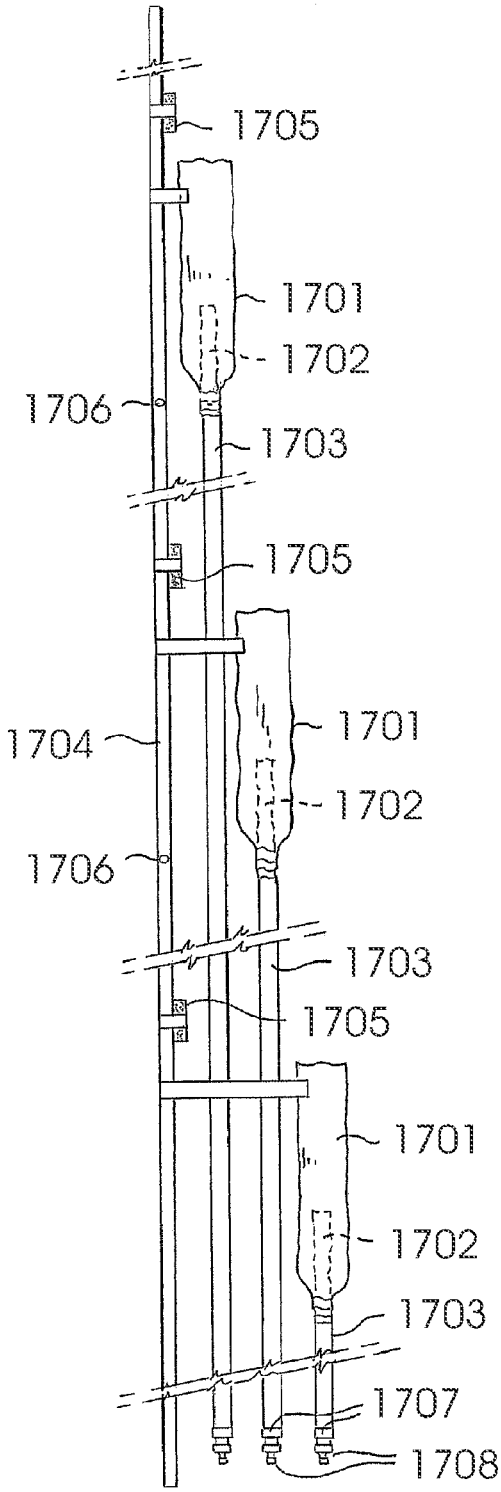
FIG. 17 illustrates another embodiment of the invention which can be used to carry out a decked blast in a shot hole.

FIG. 17 diagrammatically illustrates an economical apparatus which can be used to carry out a decked blast in a shot hole. The apparatus includes first, second and third retainers 1701, first, second and third one-way valves 1702, first, second and third charging conduits 1703, a single vent pipe 1704 and first, second and third blast initiators 1705.

The retainers 1701 each have the same form as the retainer 302 seen in FIG. 16, i.e. each of them is provided by an open ended length or sleeve of lay-flat tubing. The one-way valves 1702 have the same form as the one-way valve 303 seen in FIG. 16, i.e. each of them is provided by an open-ended length or sleeve of lay-flat tubing of smaller diameter and length than the lay-flat tubing 302. The retainers and one-way valves are, as in FIG. 16, attached to the respective charging conduits 1703 by adhesive duct tape.

The single vent pipe 1704 has an open upper end at the upper end of the drilled shot hole and is formed with holes 1706 at positions between the respective retainers. Blast initiators 1705 are attached to the vent pipe at the appropriate positions adjacent the retainers by adhesive tape. The charging conduits and vent pipe are also connected to one another by duct tape at regular intervals so that the conduits and pipe form a compact bundle. In this regard it will be understood that FIG. 17 is diagrammatic in nature in that it shows the various conduits and vent pipe in laterally spaced relationship whereas, in a practical embodiment, the duct tape holds the components together in a narrow bundle.

Adhesive tape is also used to connect the open upper ends of the retainers to the vent pipe 1704 and/or to the relevant charging conduits so that the retainers are maintained in an open-topped, extended state when the assembly is inserted into the shot hole as described below.

As in FIG. 16, each of the charging conduits is fitted at its lower end with a threaded coupler 1707 and a male Camlock-type quick coupler 1708 to which the explosive supply hose can be connected via a corresponding female coupler.

In use the entire assembly is pushed up the shot hole to the position seen in FIG. 17. The charging hose is connected to the charging conduit serving the lowermost retainer and explosive material is pumped into this retainer as previously described. When the retainer is fully charged and excess material has flow into the hole above the retainer to the required level, the charging hose is disconnected from the charging conduit and is connected to the charging conduit serving the next higher retainer and material is pumped into that retainer in order to charge it and the hole above it. The process is then repeated for the uppermost retainer.

It will be understood that, depending on the length of the shot hole, there may be two or more than three retainers and associated components to carry out the required decked blast.

It will furthermore be understood that separate initiator lines, for example wires or shock tubes, extend from the respective initiators 1705 to positions outside the hole. The initiator lines are omitted from FIG. 17 in the interests of clarity of illustration. In practice, the initiators may be selected so as to initiate the blast at different times in accordance with a predetermined blasting sequence in order to achieve optimal blasting of the rock around the hole.

After charging the quick couplers 1708 can be unscrewed from their associated couplers 1707 for re-use at other shot holes. As indicated previously in relation to FIG. 16 it is also feasible to achieve further economy by recovering for the couplers 1707 themselves for re-use.

The invention claimed is:

1. A method of charging an upwardly oriented hole with a pumpable material, the method comprising the steps of:

providing a laterally expandable retainer in the form of a length of flexible lay-flat tubing which is of smaller length than the hole, which has an inlet at an operatively lower end thereof and an outlet at an operatively upper end thereof and which, in an unexpanded state, has a smaller lateral dimension than the hole;

pushing the retainer, in an unexpanded state, upwardly into the hole by means of a suitably stiff charging conduit which is a component separate form the retainer and attached to the inlet of the retainer;

pumping material with which the hole is to be charged upwardly into the retainer through the charging conduit such that the retainer fills up and expands laterally into engagement with a wall of the hole;

allowing any excess material pumped into the retainer to flow upwardly out of the retainer through the outlet; and after the retainer has been filled with material and the hole above the retainer has been at least partially filled with any excess material, terminating the pumping of the material and closing the inlet such that material is retained in the hole by engagement of the filled and expanded retainer with the wall of the hole.

2. A method according to claim 1 wherein the pumping of material into the retainer is terminated when the hole, above the retainer, has been filled with excess material to a predetermined level.

3. A method according to claim 2 and comprising the steps of providing a non-return valve at the inlet of the retainer, and allowing the non-return valve to close when the pumping of material is terminated.

4. A method according to claim 3 wherein the non-return valve is provided in the form of a length of flexible lay-flat tubing which will collapse on itself, and thereby close the inlet, when the pumping of material is terminated.

5. A method according to claim 4 wherein the lay-flat tubing of the non-return valve has a smaller length and diameter than the lay-flat tubing of the retainer and the method includes the step of locating the lay-flat tubing of the non-return valve within the lay-flat-tubing of the retainer.

6. A method according to claim 1 and comprising the step of inserting a vent pipe into the hole in order to vent air from the hole as it is filled with pumped material.

7. A method according to claim 6 wherein the vent pipe is inserted into the hole at the same time as the retainer is inserted into the hole.

8. A method according to claim 6 when used to charge an upwardly oriented shot hole with a pumpable explosive.

9. A method according to claim 8 and comprising the step of inserting a blast initiator into the hole such that the initiator is located at an upper end of the hole.

10. A method according to claim 9 wherein the blast initiator is inserted into the hole at the same time as the retainer and vent pipe are inserted into the hole.

11. A method according to claim 9 wherein the blast initiator is attached to the vent pipe and the vent pipe is attached to the charging conduit, the method comprising the step of pushing the vent pipe and charging conduit upwardly into the hole at the same time.

12. A method according to claim 8 wherein the shot hole is charged with a decked charge, the method comprising the steps of providing a plurality of retainers, providing a charging conduit for each retainer, providing a blast initiator for each retainer, and inserting the retainers and blast initiators simultaneously into the hole such that the retainers are situated one above the other and spaced apart from one another with a blast initiator adjacent each retainer.

13. A method according to claim 12 wherein a single vent pipe is provided, the vent pipe having an inlet therein for each space between two retainers and above the uppermost retainer.

14. A method according to claim 13 wherein the charging conduits are provided as separate conduits each of which extends to the mouth of the shot hole for connection to an explosive supply conduit.

15. A method according to claim 14 wherein the retainers are filled with explosive material in turn from the lowermost retainer to the uppermost one.

16. A method according to claim 15 wherein the charging conduits are attached to one another and to the vent pipe.

17. A method according to claim 16 wherein the charging conduits and vent pipe are attached to one another by adhesive tape.

18. An apparatus for charging an upwardly oriented hole with a pumpable material, the apparatus including a laterally expandable retainer comprising a length of lay flat tubing which is of smaller length than the hole, which has an inlet at an operatively lower end thereof and an outlet at an operatively upper end thereof and which, in an unexpanded state, has a smaller lateral dimension than the hole, a charging conduit, separate from the retainer, to an operatively upper end of which the inlet of the retainer is attached and which is sufficiently stiff to push the retainer upwardly into the hole in an unexpanded state, whereafter material with which the hole is to be charged can be pumped into the retainer through the inlet via the charging conduit such that the retainer fills up and expands laterally into engagement with a wall of the hole, with excess material being able to flow upwardly out of the retainer through the outlet, and means for closing the inlet after the retainer and at least a portion of the hole above the retainer have been filled with material and pumping of material has been terminated, such that engagement between the filled and expanded retainer and the wall of the hole serves to retain the material in the hole.

19. An apparatus according to claim 18 and comprising a non-return valve, at the inlet of the retainer, arranged to close when the pumping of material is terminated.

20. An apparatus according to claim 19 wherein the non-return valve comprises a length of flexible lay-flat tubing.

21. An apparatus according to claim 20 wherein the lay-flat tubing of the non-return valve has a smaller length and diameter than the lay-flat tubing of the retainer and the lay-flat tubing of the non-return valve is located inside the lay-flat-tubing of the retainer.

22. An apparatus according to claim 21 wherein operatively lower ends of the lay-flat tubing of the non-return valve and of the lay-flat tubing of the retainer are fastened to an operatively upper end of the charging conduit.

23. An apparatus according to claim 22 wherein the operatively lower ends of the lay-flat tubing of the non-return valve and of the lay-flat tubing of the retainer are fastened to an operatively upper end of the charging conduit by means of adhesive tape.

24. An apparatus according to claim 18 and comprising a vent pipe which is insertable into the hole such that the vent pipe extends to an upper end of the hole to vent air from the hole as it is filled with pumped material.

25. An apparatus according to claim 24 when used to charge an upwardly oriented shot hole with a pumpable explosive.

26. An apparatus according to claim 25 and comprising a blast initiator locatable in the hole such that the initiator is located at an upper end of the hole.

27. An apparatus according to claim 26 wherein the blast initiator is attached to an operatively upper and end of the vent pipe and the vent pipe is attached to the charging conduit, such that the vent pipe and charging conduit can be pushed upwardly into the hole at the same time.

28. An apparatus according to claim 25 wherein the apparatus is arranged for charging of a shot hole with a decked charge, the apparatus comprising a plurality of retainers, a charging conduit for each retainer and a blast initiator for each retainer, the arrangement being such that the retainers, charging conduits an blast initiators can be inserted simultaneously into the hole such that the retainers are situated one above the other and spaced apart from one another with a blast initiator adjacent each retainer.

29. An apparatus according to claim 28 comprising a single vent pipe which has inlets therein for each space between two retainers and for a space above the uppermost retainer.

30. An apparatus according to claim 29 wherein the charging conduits are separated conduits each of which extends in use to the mouth of the shot hole for connection to an explosive supply conduit.

31. An apparatus according to claim 30 wherein the charging conduits are attached to one another and to the vent pipe.

32. An apparatus according to claim 31 wherein the charging conduits and vent pipe are attached to one another by adhesive tape.

33. An apparatus according to claim 18 and comprising, for each charging conduit, a quick-coupler which is removeably connected to an operatively lower end of the charging conduit.

* * * * *

UNITED STATES PATENT AND TRADEMARK OFFICE

CERTIFICATE OF CORRECTION

PATENT NO. : 8,381,653 B2
APPLICATION NO. : 12/961174
DATED : February 26, 2013
INVENTOR(S) : Leon Michael Zimmermann It is certified that error appears in the above-identified patent and that said Letters Patent is hereby corrected as shown below:

In the Claims:

Column 14, line 45, please delete “an” and insert --and--.

Signed and Sealed this
Twenty-third Day of April, 2013

Teresa Stanek Rea
*Acting Director of the United States Patent and Trademark Office*